US010317056B2

(12) United States Patent
Fujisawa

(10) Patent No.: US 10,317,056 B2
(45) Date of Patent: Jun. 11, 2019

(54) DRIVE APPARATUS AND ILLUMINATION APPARATUS

(71) Applicant: MINEBEA MITSUMI INC., Nagano (JP)

(72) Inventor: Shinichi Fujisawa, Akiruno (JP)

(73) Assignee: MINEBEA MITSUMI INC., Nagano (JP)

( * ) Notice: Subject to any disclaimer, the term of this patent is extended or adjusted under 35 U.S.C. 154(b) by 93 days.

(21) Appl. No.: 15/490,146

(22) Filed: Apr. 18, 2017

(65) Prior Publication Data

US 2017/0307195 A1 Oct. 26, 2017

(30) Foreign Application Priority Data

Apr. 22, 2016 (JP) ..... 2016-086351

(51) Int. Cl.
*F21V 14/04* (2006.01)
*F21V 14/06* (2006.01)
(Continued)

(52) U.S. Cl.
CPC ..... *F21V 21/15* (2013.01); *F21V 7/00* (2013.01); *F21V 14/04* (2013.01); *F21V 21/108* (2013.01);
(Continued)

(58) Field of Classification Search
CPC ..... F21V 21/15; F21V 21/14; F21V 21/108; F21V 23/0435
See application file for complete search history.

(56) References Cited

U.S. PATENT DOCUMENTS 5,882,107 A 3/1999 Bornhorst et al.
6,964,503 B2 * 11/2005 Smith ..... F21V 21/15 362/371
(Continued)

FOREIGN PATENT DOCUMENTS

JP H09-259609 A 10/1997
JP 2004-109392 A 4/2004
(Continued)

OTHER PUBLICATIONS

Jun. 7, 2017 Extended European Search Report issued in Patent Application No. EP17167397.3.
(Continued)

*Primary Examiner* — William N Harris
(74) *Attorney, Agent, or Firm* — Oliff PLC

(57) ABSTRACT

A drive apparatus according to an embodiment includes a support unit, an arm, an operation target and a bias part. The support unit includes an electrically-driven first driving source. The arm is supported by the support unit at one end part of the arm, and is, by the first driving source, rotatable about a first rotational axis that is along an extending direction of another end part of the arm extending from the one end part, the arm including an electrically-driven second driving source. The operation target is attached to the another end part side of the arm, and is, by the second driving source, rotatable about a second rotational axis intersecting with the extending direction. The bias part biases the operation target in a direction toward the arm along the second rotational axis.

11 Claims, 20 Drawing Sheets

(51) Int. Cl.

| | |
|---|---|
| ***F21V 21/14*** | (2006.01) |
| ***F21V 21/15*** | (2006.01) |
| ***F21V 21/108*** | (2006.01) |
| ***F21V 7/00*** | (2006.01) |
| ***F21V 29/76*** | (2015.01) |
| *F21V 21/36* | (2006.01) |
| *F21Y 115/10* | (2016.01) |

(52) U.S. Cl.
CPC ..... *F21V 21/14* (2013.01); *F21V 29/76* (2015.01); *F21V 14/06* (2013.01); *F21V 21/36* (2013.01); *F21Y 2115/10* (2016.08)

(56) References Cited

U.S. PATENT DOCUMENTS

2007/0019947 A1* 1/2007 Shimada ..... G03B 35/00 396/329
2008/0159732 A1 7/2008 Young et al.
2011/0261568 A1* 10/2011 Dalsgaard ..... F21V 21/30 362/249.03
2014/0177258 A1* 6/2014 Gebhard ..... B60Q 1/245 362/547
2014/0204218 A1* 7/2014 Gebhard ..... F21V 21/30 348/164
2017/0074488 A1 3/2017 Fujisawa et al.

FOREIGN PATENT DOCUMENTS

JP 2009-110717 A 5/2009
JP 2015-225799 A 12/2015

OTHER PUBLICATIONS

Dec. 12, 2017 Office Action issued in Japanese Patent Application No. 2016-086351.

* cited by examiner

DRIVE APPARATUS AND ILLUMINATION APPARATUS

CROSS-REFERENCE TO RELATED APPLICATION(S)

The present application claims priority to and incorporates by reference the entire contents of Japanese Patent Application No. 2016-086351 filed in Japan on Apr. 22, 2016.

BACKGROUND OF THE INVENTION

1. Field of the Invention

The present invention relates to a drive apparatus and an illumination apparatus.

2. Description of the Related Art

Conventionally, an illumination apparatus has been provided that is capable of changing the irradiation direction of a spotlight included in the illumination apparatus in any direction (see Japanese Patent Application Laid-open No. 2009-110717). Such an illumination apparatus (drive apparatus) rotatably and pivotally supports, for example, a lamp body thereof on one side of the lamp body by an arm extending from a support unit attached to a ceiling surface. In this case, the arm pivotally supported by the support unit is rotated thus changing the direction of the lamp body in the horizontal direction (panning direction), and the lamp body pivotally supported by the arm is rotated thus changing the direction of the lamp body in the vertical direction (tilting directions).

However, in the above-mentioned conventional technique, it is difficult to suppress troubles due to the weight of an operation target such as a light source or the lamp body in a state in which the operation target is capable of changing the direction thereof in an intended direction. For example, in the above-mentioned drive apparatus, the operation target is pivotally supported by the arm on the one side of the operation target and hence, there may be a case that the troubles due to the weight of the operation target are, for example, caused in a connection part between the operation target and the arm.

The present invention has been made under such circumstances, and it is an object of the present invention to provide a drive apparatus and an illumination apparatus that are capable of suppressing the troubles due to the weight of the operation target in a state in which the operation target is capable of changing the direction thereof in an intended direction.

SUMMARY OF THE INVENTION

It is an object of the present invention to at least partially solve the problems in the conventional technology.

A drive apparatus according to an embodiment includes a support unit, an arm, an operation target and a bias part. The support unit includes an electrically-driven first driving source. The arm is supported by the support unit at one end part of the arm, and is, by the first driving source, rotatable about a first rotational axis that is along an extending direction of another end part of the arm extending from the one end part, the arm including an electrically-driven second driving source. The operation target is attached to the another end part side of the arm, and is, by the second driving source, rotatable about a second rotational axis intersecting with the extending direction. The bias part biases the operation target in a direction toward the arm along the second rotational axis.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
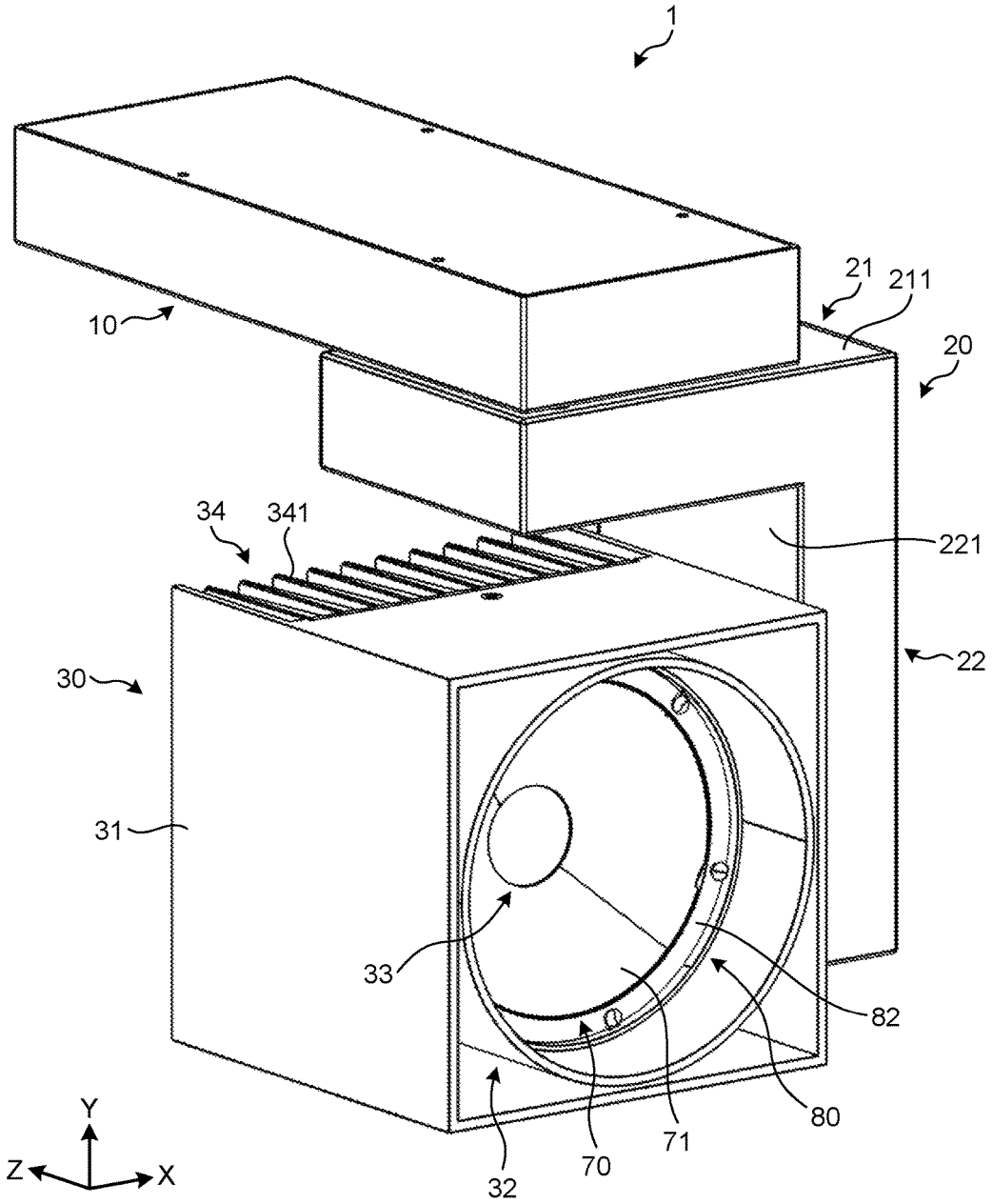
FIG. 1 is a perspective view illustrating an illumination apparatus according to an embodiment.

In an embodiment mentioned below, an illumination apparatus 1 is explained with reference to drawings as one example of a drive apparatus. For example, the illumination apparatus 1 has a light source unit 30 including a light source (not illustrated in the drawings), as an operation target. Here, the use of the drive apparatus is not limited to the embodiment explained below. Furthermore, it is necessary to consider that each of the drawings is a schematic drawing and hence, there may be a case that a dimensional relation between respective elements, or the dimensional ratio between the respective elements are different from actual dimensions. In the relation between the drawings also, there may be a case that the dimensional relations or the dimensional ratios illustrated in the respective drawings are different from each other.

Embodiment

Figure 2:
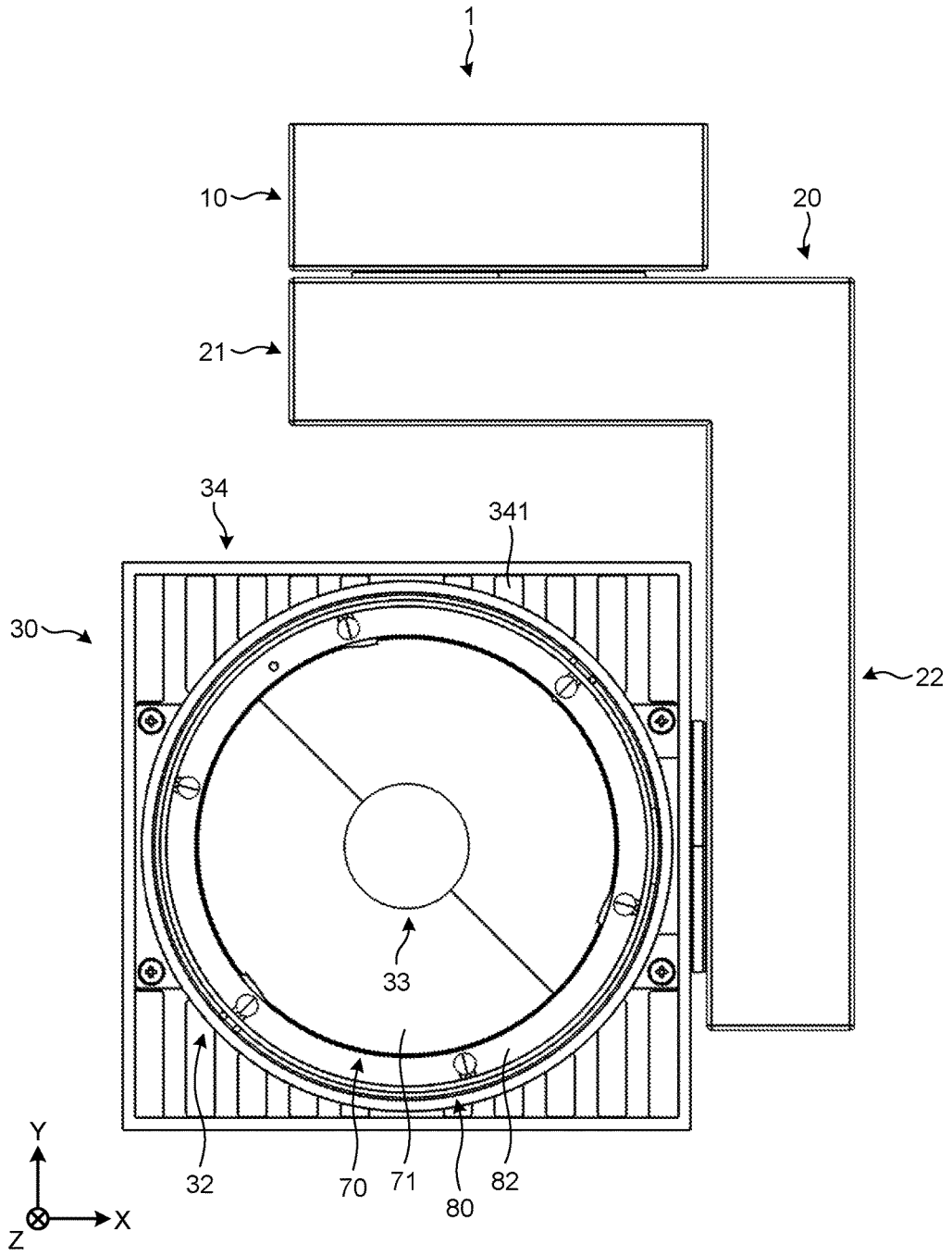
FIG. 2 is a front view illustrating the illumination apparatus according to the embodiment.

First of all, the outline of the constitution of the illumination apparatus 1 is explained in conjunction with FIG. 1 and FIG. 2. FIG. 1 is a perspective view illustrating the illumination apparatus 1 as viewed from the light source unit 30 side of the illumination apparatus 1. FIG. 2 is a front view of the illumination apparatus 1.

Hereinafter, the direction along the rotational axis (hereinafter, referred also to as "first rotational axis") of an arm 20 mentioned below indicates a Y axis, and an X axis and a Z axis are orthogonal to each other in the plane orthogonal to the Y axis. For example, the X-axis is taken along the rotational axis (hereinafter, referred also to as "second rotational axis") of the light source unit 30 at the attachment position (initial position) of the illumination apparatus 1.

The illumination apparatus 1 has a support unit 10, the arm 20, and the light source unit 30. As illustrated in FIG. 2, the light source unit 30 is arranged below the support unit 10 in the gravity direction (Y-axis negative direction), and arranged at the position such that the light source unit 30 overlaps with the support unit 10 as viewed in a plan view.

The support unit 10 is formed in a rectangular box shape. Here, the support unit 10 may be formed of any material, and may be, for example, formed of an aluminum material. The support unit 10 houses therein a power supply board (not illustrated in the drawings) that supplies power to elements such as a first motor 45, a second motor 61, or a light emitting part 33, the elements being described later. Furthermore, the support unit 10 is attached to a predetermined object (structure) such as a ceiling through an engagement part (not illustrated in the drawings) arranged in the surface (upper surface in FIG. 2) that faces in the Y-axis positive direction. For example, the support unit 10 is detachably attached to a rail (not illustrated in the drawings) arranged on a ceiling surface through the engagement part.

Hereinafter, the Y-axis positive direction indicates the upward direction, the Y-axis negative direction indicates the downward direction, and the direction orthogonal to the Y-axis indicates the horizontal direction. In this case, for example, the Y-axis negative direction assumes the gravity direction, and a plane orthogonal to the Y-axis assumes a horizontal plane.

Figure 3:
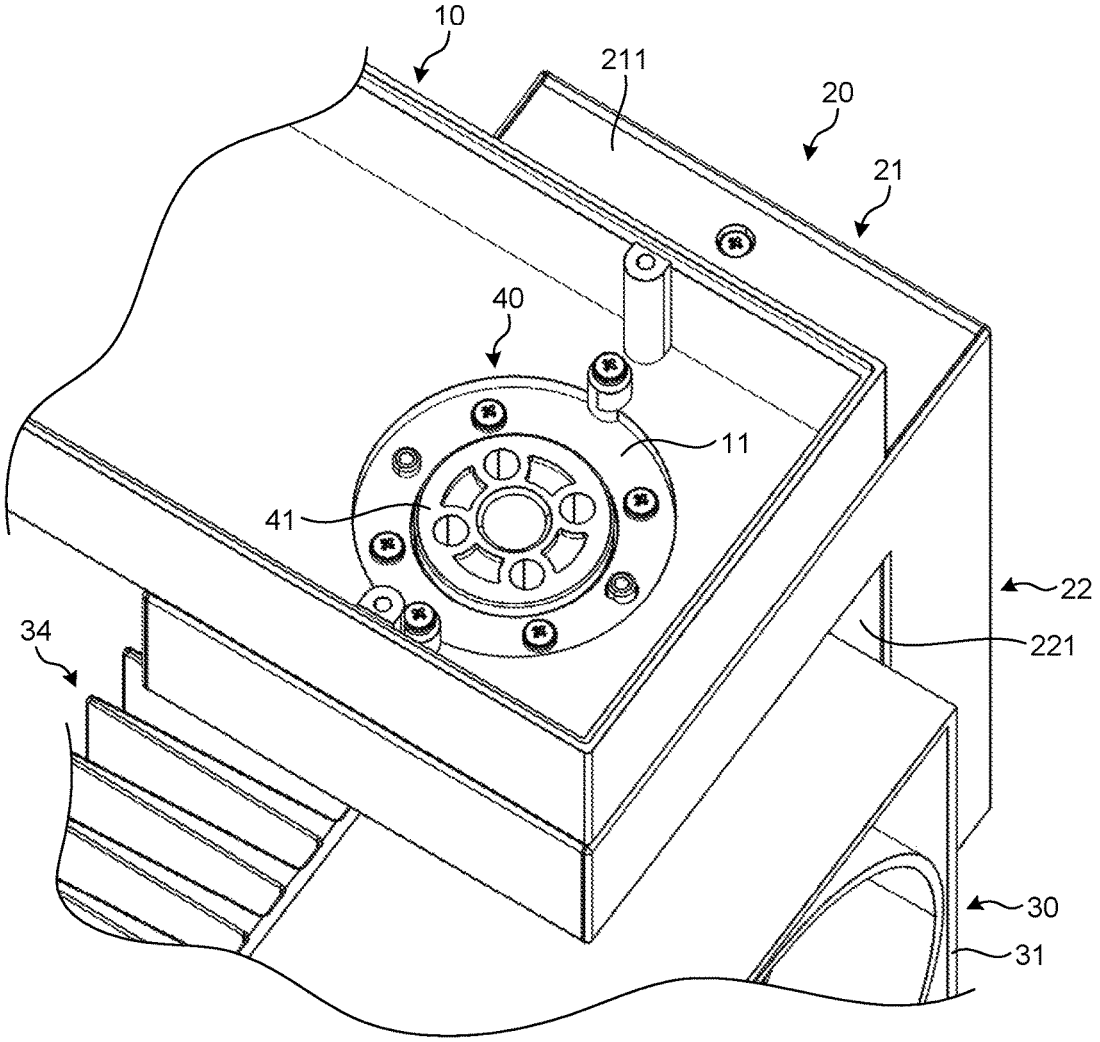
FIG. 3 is a perspective view illustrating the essential part of a support unit in the illumination apparatus according to the embodiment.

As illustrated in FIG. 3, the support unit 10 forms a recessed portion 11 in the surface (the bottom surface of the support unit 10 in FIG. 2) that faces in the Y-axis negative direction, the recessed portion 11 having an opening in the center thereof. FIG. 3 is a perspective view illustrating the essential part of the support unit in the illumination apparatus according to the embodiment. In the support unit 10, a first shaft 41 of a first rotational part 40 described later is inserted into the opening of the recessed portion 11, and the recessed portion 11 attaches an internal-gear part 42 (see FIG. 4) thereto with the use of screw members or the like. Due to such constitution, the arm 20 rotates about the center axis (first rotational axis) of the first shaft 41, as will be specifically described later.

Figure 4:
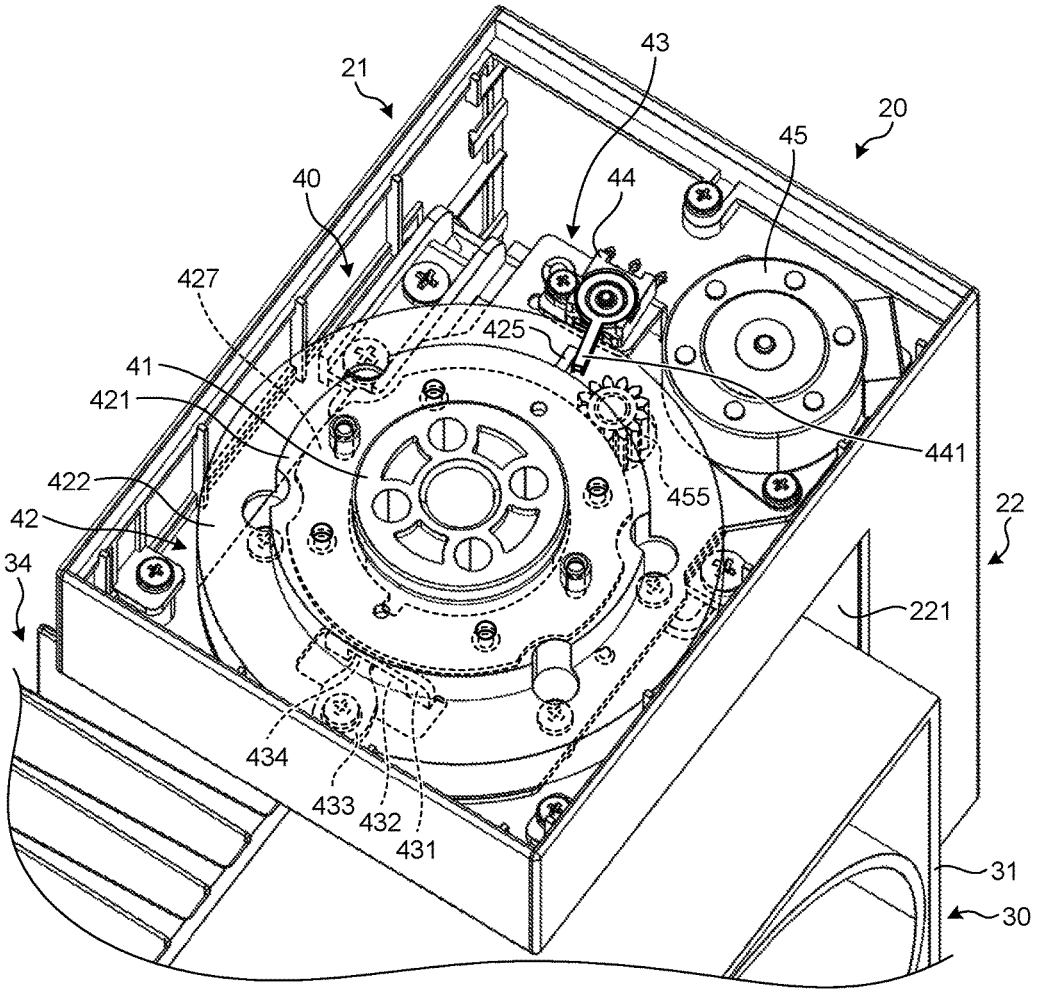
FIG. 4 is a perspective view illustrating the inside of one end part of an arm in the illumination apparatus according to the embodiment.

One end part 21 of the arm 20 is arranged close to the part in which the recessed portion 11 of the support unit 10 is formed. As illustrated in FIG. 4, in the one end part 21 of the arm 20, the first rotational part 40 having the first motor 45 is arranged. FIG. 4 is a perspective view illustrating the inside of the one end part of the arm in the illumination apparatus according to the embodiment. To be more specific, FIG. 4 is a perspective view illustrating the internal-gear part 42 in a see-through manner except for a top cover 211 of the one end part 21 of the arm 20.

The first rotational part 40 has the first shaft 41, the internal-gear part 42, and a first bracket 43.

Figure 5:
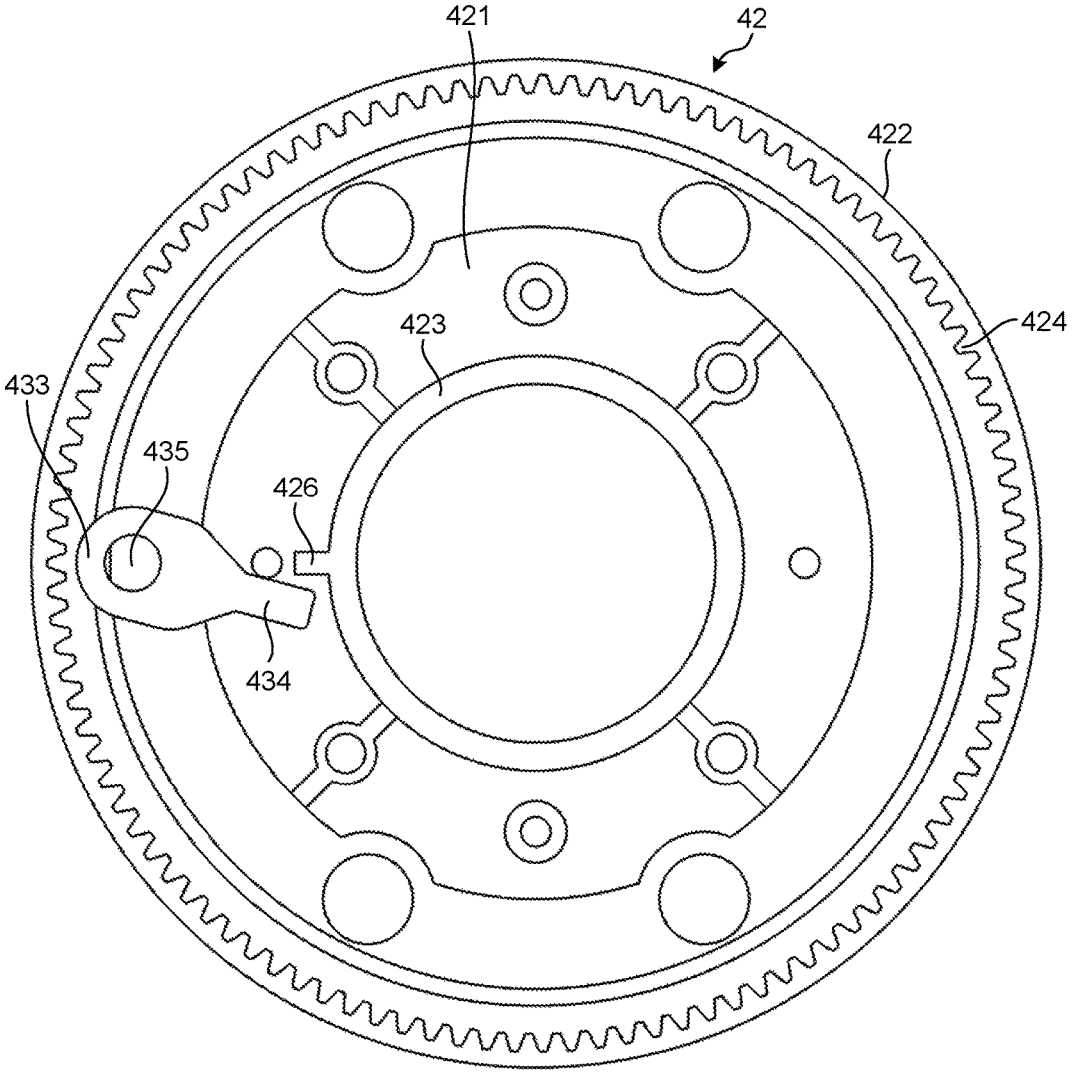
FIG. 5 is a plan view illustrating an internal-gear part of the illumination apparatus according to the embodiment.

The internal-gear part 42 has a first cylindrical portion 421, and a second cylindrical portion 422. For example, the internal-gear part 42 is formed of a resin material or the like. FIG. 5 is a plan view illustrating the internal-gear part of the illumination apparatus according to the embodiment. To be more specific, FIG. 5 illustrates the plan view of the internal-gear part 42 as viewed from the second cylindrical portion 422 side (bottom side) of the internal-gear part 42. Here, in FIG. 5, a restriction pin 433 of the first bracket 43 is illustrated in order to indicate a positional relation with a second projecting portion 426 of the internal-gear part 42, as will be specifically described later.

The second cylindrical portion 422 is formed in such a manner that the second cylindrical portion 422 is larger in diameter than the first cylindrical portion 421, and a surface of the second cylindrical portion 422 is opened, the surface being opposite to the part continuously extending to the first cylindrical portion 421. The second cylindrical portion 422 has internal teeth 424 formed in the inner peripheral face thereof. In the example illustrated in FIG. 5, the internal teeth 424 are formed over the entire circumference of the inner peripheral face of the second cylindrical portion 422. Furthermore, a first projecting portion 425 (see FIG. 4) projects from the outer peripheral face of the first cylindrical portion 421 along the planar surface of the second cylindrical portion 422.

As illustrated in FIG. 5, the inside of the first cylindrical portion 421 and the inside of the second cylindrical portion 422 are communicated with each other, and an insertion part 423 formed in a cylindrical shape is formed in the center portion of the first cylindrical portion 421 and the second cylindrical portion 422. The first shaft 41 is inserted into the insertion part 423 of the internal-gear part 42. In the top cover 211 of the one end part 21, the part that overlaps with the recessed portion 11 of the support unit 10 is opened, and the first cylindrical portion 421 is attached to the recessed portion 11 with the use of screw members or the like. On the inside of the first cylindrical portion 421, a reinforcing plate 427 (see FIG. 4) formed in an annular shape is arranged, and both the first cylindrical portion 421 and the reinforcing plate 427 are attached to the recessed portion 11 with the use of screw members or the like. The reinforcing plate 427 is made of a metallic material or the like. Due to such constitution, the first shaft 41 is rotatably arranged on the inside of the opening of the recessed portion 11 and the insertion part 423 of the internal-gear part 42. Furthermore, while the reinforcing plate 427 keeps the intended strength of the connection portion between the support unit 10 and the arm 20, the arm 20 is hung from the support unit 10. The illumination apparatus 1 may be provided with no reinforcing plate 427.

Figure 6:
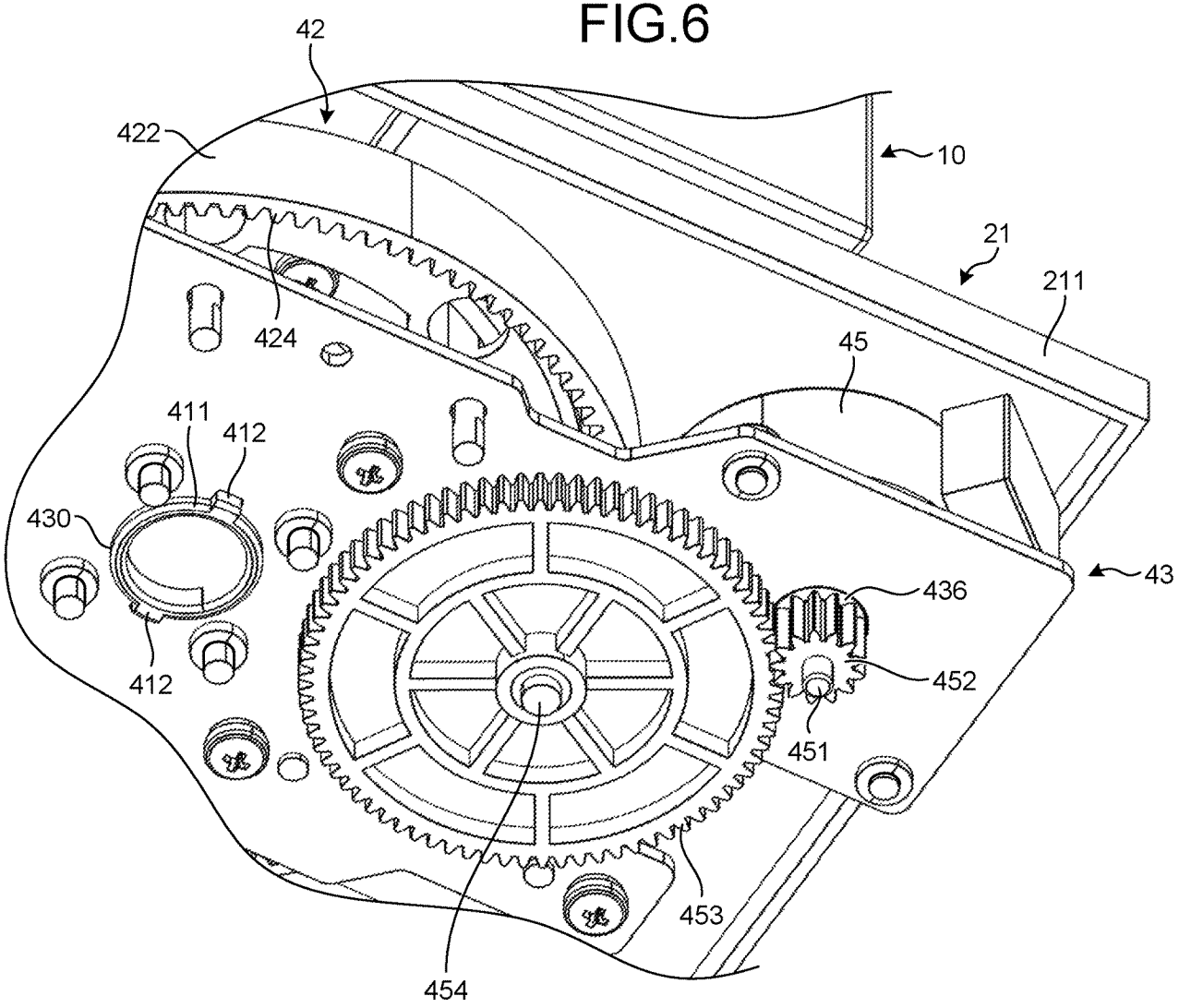
FIG. 6 is a perspective view illustrating the inside of the one end part of the arm in the illumination apparatus according to the embodiment.

Furthermore, the first bracket 43 is arranged on the second cylindrical portion 422 side of the internal-gear part 42. As illustrated in FIG. 6, the first bracket 43 is provided with an insertion hole 430 into which a distal end portion 411 of the first shaft 41 is inserted. The distal end portion 411 of the first shaft 41 inserted into the first cylindrical portion 421 is inserted into the insertion hole 430. FIG. 6 is a perspective view illustrating the inside of the one end part of the arm in the illumination apparatus according to the embodiment. To be more specific, FIG. 6 is a perspective view illustrating the inside of the one end part of the arm as viewed from a side opposite to the support unit 10 except for a housing part other than the top-cover 211 of the one end part 21 of the arm 20.

For example, as illustrated in FIG. 6, the distal end portion 411 of the first shaft 41 is inserted into the insertion hole 430 provided to the first bracket 43 in such a state that the position of the first shaft 41 in the rotational direction is restricted. To be more specific, the distal end portion 411 of the first shaft 41 is provided with a pair of restriction pieces 412 projecting in directions away from each other. The distal end portion 411 having the pair of restriction pieces 412 is inserted into the insertion hole 430 of the first bracket 43 that is formed in a shape corresponding to the shape of the distal end portion 411 thus restricting the position of the first shaft 41 with respect to the first bracket 43 in the rotational direction. Due to such constitution, the first shaft 41 and the first bracket 43 rotate together with each other about the first rotational axis. Furthermore, the first bracket 43 is, for example, attached to the one end part 21 of the arm 20 with the use of screw members or the like, and the rotation of the first bracket 43 also causes the arm 20 to rotate about the first rotational axis.

As illustrated in FIG. 4, in the first bracket 43, a first switch 44 is arranged at a position along the outer peripheral face of the second cylindrical portion 422 of the internal-gear part 42. For example, the first switch 44 is arranged in such a manner that a lever 441 projects to the first cylindrical portion 421 side along the planar surface of the second cylindrical portion 422. For example, the lever 441 of the first switch 44 is arranged in such a manner that the lever 441 projects to a position such that the lever 441 overlaps with the first projecting portion 425 of the internal-gear part 42 in the circumferential direction of the first cylindrical portion 421. The first projecting portion 425 of the internal-gear part 42 rotates the lever 441 of the first switch 44 thus detecting the limit of the rotational angle set to stop the operation of the first motor 45. This mechanism is used for motor control as described above. In the present embodiment, the first bracket 43; that is, the arm 20, restricts the rotational angle thereof in the horizontal direction within the range of approximately 360° by the first switch 44 and the first projecting portion 425 of the internal-gear part 42.

The first bracket 43 is provided with a raised part 431 arranged at a position such that the raised part 431 overlaps with the second cylindrical portion 422 of the internal-gear part 42. The raised part 431 forms an insertion groove 432 therein. Furthermore, the first bracket 43 is provided with the restriction pin 433 arranged at a position such that the restriction pin 433 overlaps with the second cylindrical portion 422 of the internal-gear part 42. The raised part 431 forms the insertion groove 432 therein. A distal end portion 434 of the restriction pin 433 is arranged in the insertion groove 432 of the raised part 431 in a horizontally movable manner. For example, as illustrated in FIG. 5, the restriction pin 433 is provided with an insertion hole 435, and screw members or the like are threadedly engaged into the insertion hole 435 thus attaching the restriction pin 433 to the planar part of the first bracket 43. The distal end portion 434 of the restriction pin 433 is capable of rotating about the insertion hole 435. Due to such constitution, the distal end portion 434 of the restriction pin 433 is arranged in the insertion groove 432 of the raised part 431 in a horizontally movable manner.

Furthermore, the internal-gear part 42 has the second projecting portion 426 projecting from the outer peripheral face of the insertion part 423. For example, the second projecting portion 426 is formed on the end portion on the second cylindrical portion 422 side of the insertion part 423 in a projecting manner toward the second cylindrical portion 422. For example, the second projecting portion 426 of the internal-gear part 42 is arranged in such a manner that the second projecting portion 426 projects to a position such that the second projecting portion 426 overlaps with the distal end portion 434 of the restriction pin 433 in the circumferential direction of the insertion part 423. Here, the second projecting portion 426 of the internal-gear part 42 is brought into contact with the distal end portion 434 of the restriction pin 433 thus restricting physically the rotation of the arm 20 about the first rotational axis. Furthermore, as illustrated in FIG. 4, the distal end portion 434 of the restriction pin 433 is horizontally movable in the insertion groove 432 of the raised part 431 and hence, the distal end portion 434 moves freely between both ends of the insertion groove 432 in the horizontal direction. In this manner, the second projecting portion 426, the restriction pin 433, and the raised part 431 are capable of restricting the rotation of the arm 20 about the first rotational axis within such an intended range as 360°.

The first rotational part 40 has the first motor 45 as an electrically-driven first driving source. As illustrated in FIG. 4, the first motor 45 is attached to the first bracket 43. For example, a stepping motor is used for the first motor 45, which is connected to a controller 50 (see FIG. 7) through lead wires (not illustrated in the drawings) extending from the first motor 45. As illustrated in FIG. 6, an output rotation shaft 451 of the first motor 45 is inserted into a through hole 436 formed in the planar part of the first bracket 43, and projects to an opposite surface side (lower side in FIG. 4) of the first bracket 43.

Furthermore, a gear 452 is attached to the output rotation shaft 451 of the first motor 45. The gear 452 attached to the output rotation shaft 451 of the first motor 45 is meshed with a large-diameter gear 453. A small-diameter gear 455 (see FIG. 4) is attached to a rotational shaft 454 to which the large-diameter gear 453 is attached. That is, the large-diameter gear 453 and the small-diameter gear 455 rotate about the rotational shaft 454. Here, the large-diameter gear 453 and the small-diameter gear 455 may be integrally formed by molding.

Furthermore, in the rotational shaft 454, one end portion opposite to the other end portion to which the large-diameter gear 453 is attached is inserted into a through hole (not illustrated in the drawings) formed in the planar part of the first bracket 43, and projects to the other surface side (upper side in FIG. 4) of the first bracket 43. Accordingly, the small-diameter gear 455 is, as illustrated in FIG. 4, arranged on the planar part of the first bracket 43.

The small-diameter gear 455 is meshed with the internal teeth 424 (see FIG. 5) of the internal-gear part 42. Furthermore, as mentioned above, the internal-gear part 42 is attached to the support unit 10. Accordingly, the small-diameter gear 455 is moved along the internal teeth 424 depending on the output of the first motor 45. Due to such constitution, the arm 20 is rotated about the first rotational axis by the output of the first motor 45.

Figure 7:
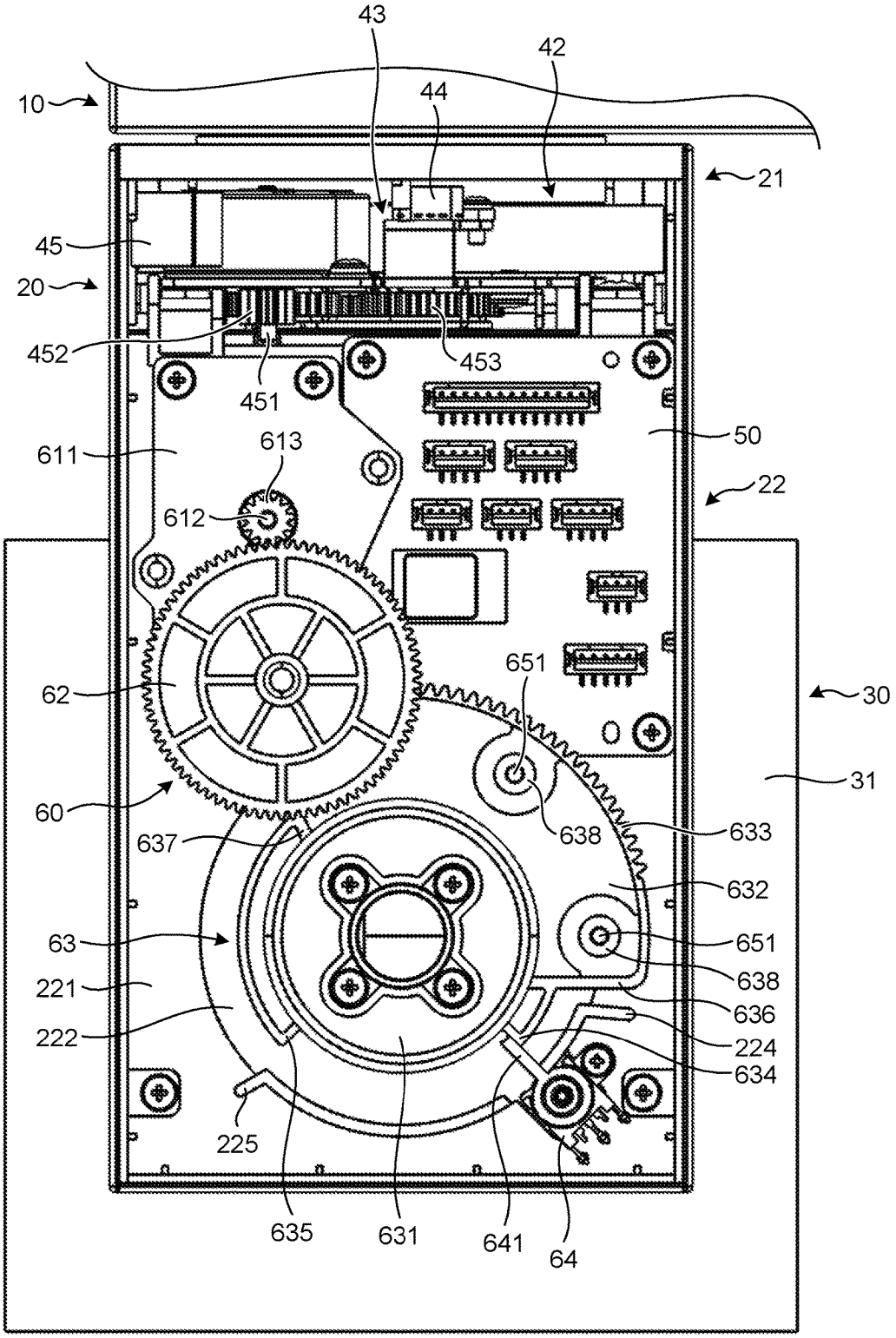
FIG. 7 is a front view illustrating the inside of another end part of the arm in the illumination apparatus according to the embodiment.
Figure 8:
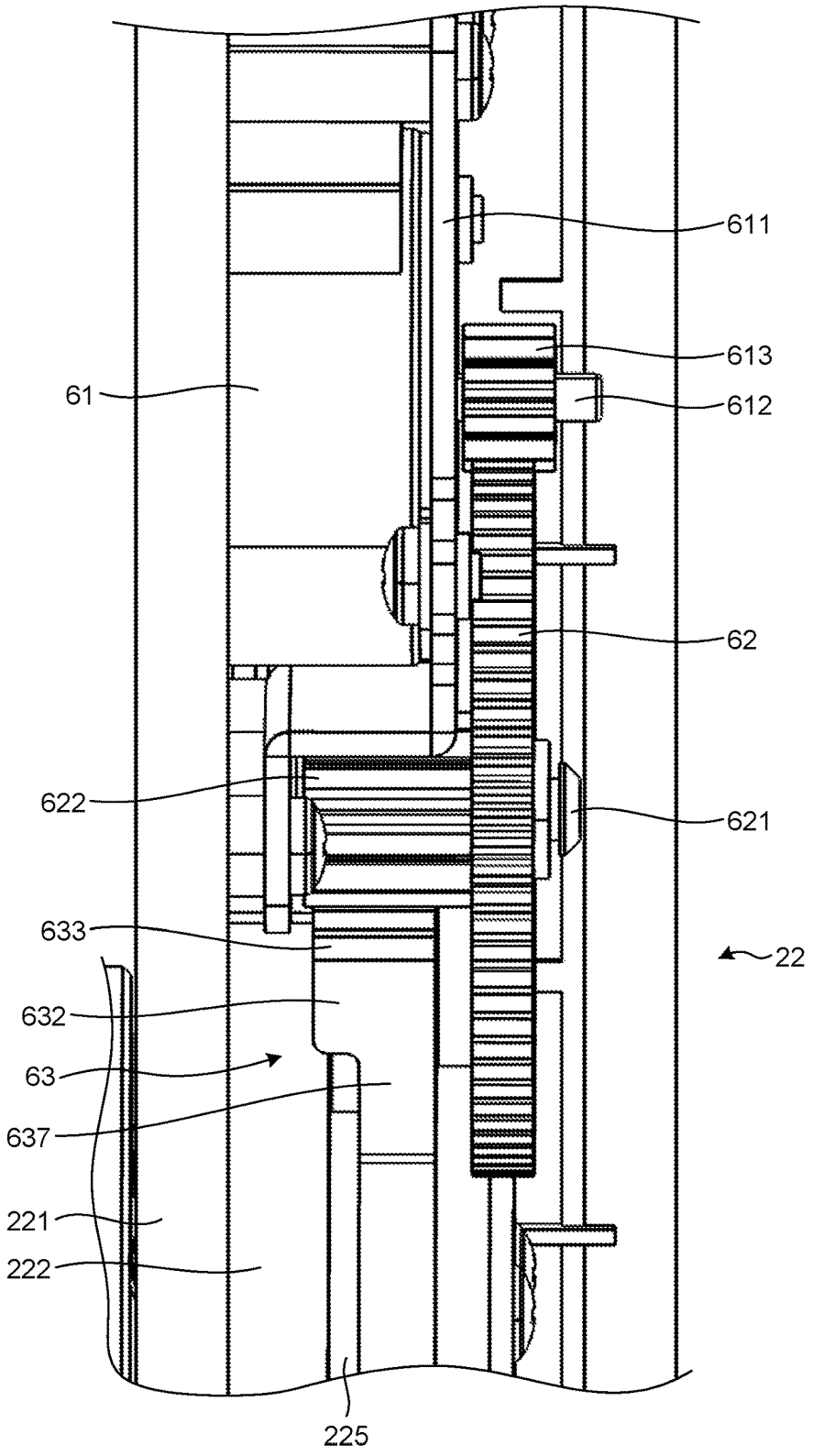
FIG. 8 is a side view illustrating the essential part on the inside of the other end part of the arm in the illumination apparatus according to the embodiment.
Figure 9:
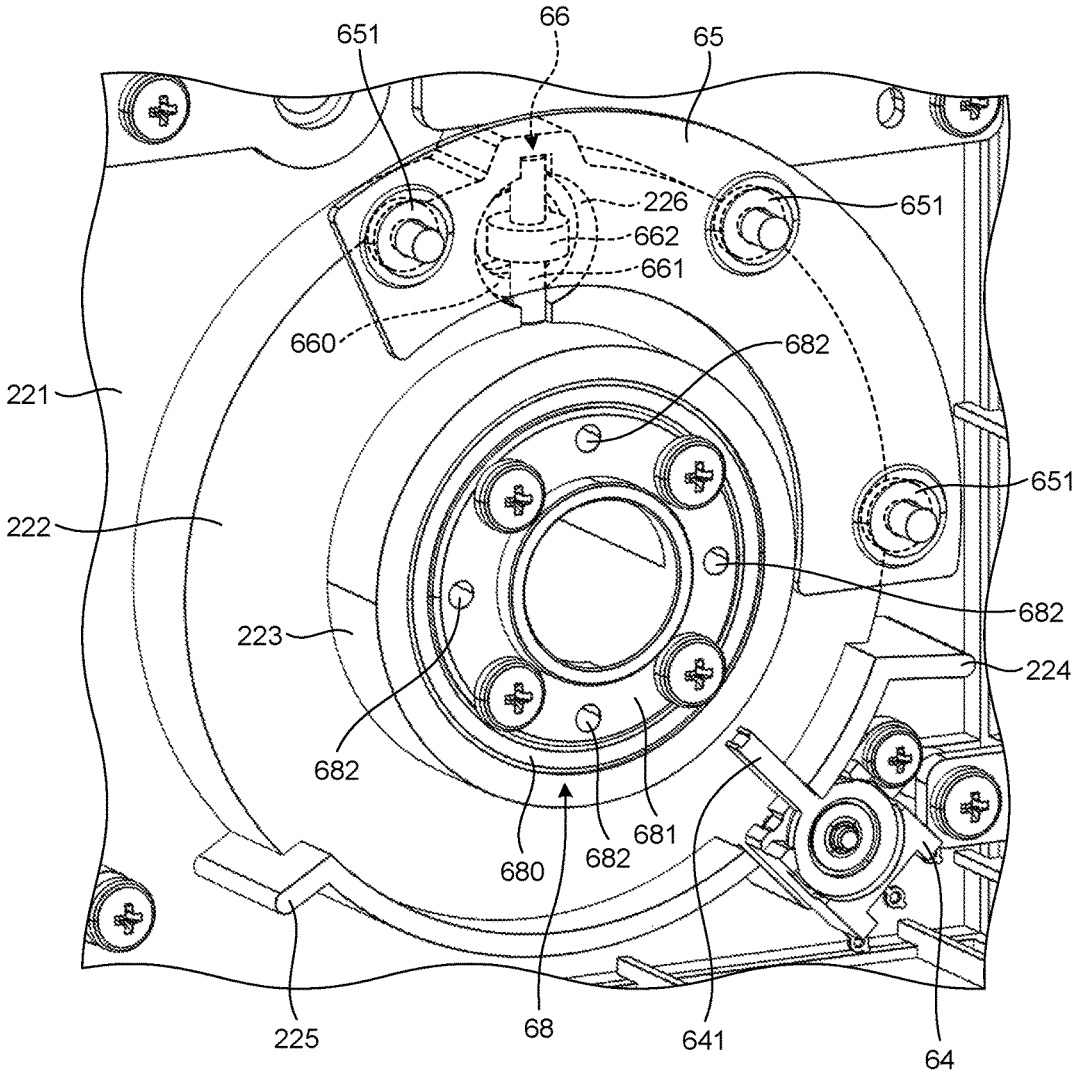
FIG. 9 is a perspective view illustrating the essential part on the inside of the other end part of the arm in the illumination apparatus according to the embodiment.

Next, the constitution on the inside of another end part 22 of the arm 20 is explained in conjunction with FIG. 7 to FIG. 9. FIG. 7 is a front view illustrating the inside of the other end part of the arm in the illumination apparatus according to the embodiment. To be more specific, FIG. 7 is a front view illustrating the inside of the another end part 22 of the arm 20 except for the face opposite to an attachment face 221 of the another end part 22. FIG. 8 is a side view illustrating the essential part on the inside of the other end part of the arm in the illumination apparatus according to the embodiment. To be more specific, FIG. 8 is a side view illustrating the inside of the another end part 22 of the arm 20 except for the side face continuously extending to an end portion of the attachment face 221 of the another end part 22. FIG. 9 is a perspective view illustrating the essential part on the inside of the other end part of the arm in the illumination apparatus according to the embodiment. To be more specific, FIG. 9 is a perspective view illustrating the essential part on the inside of the another end part 22 of the arm 20, except for an attachment gear part 63 described later, in such a state that a reinforcing plate 65 described later is illustrated in a see-through manner.

As illustrated in FIG. 7, the controller 50 and a second rotational part 60 are arranged on the inside of the another end part 22 of the arm 20. In the example illustrated in FIG. 7, the controller 50 is a control board that controls the first motor 45 as the first driving source, and the second motor 61 (see FIG. 8) as an electrically-driven second driving source described later. The controller 50 has a wireless communication function, such as Bluetooth (registered trademark), and may accept an instruction of driving the first motor 45 or the second motor 61 from the outside thereof by using the wireless communication function. Furthermore, the controller 50 may accept an instruction of controlling a light quantity of the light source unit 30 from the outside thereof by using the wireless communication function. As illustrated in FIG. 7, the controller 50 is arranged in the vicinity of the second motor 61 or the first motor 45 thus shortening wiring such as lead wires connected to the second motor 61 or the first motor 45, and improving the assemblability of the illumination apparatus. Furthermore, the wiring such as the lead wire that connects the controller 50, and the second motor 61 or the first motor 45 is shortened thus suppressing the effect of a noise.

As illustrated in FIG. 8, the second rotational part 60 has the second motor 61 as the second driving source. For example, a stepping motor is used for the second motor 61, which is connected to the controller 50 (see FIG. 7) through lead wires (not illustrated in the drawings) extending from the second motors 61. Furthermore, the second motor 61 is attached to one side of a second bracket 611, and an output rotation shaft 612 of the second motor 61 is inserted into a through hole formed in the second bracket 611, and projects to the other side of the second bracket 611. In the output rotation shaft 612 of the second motor 61, a gear 613 is attached to a part of the output rotation shaft 612 that is projected to the other side of the second bracket 611.

Furthermore, as illustrated in FIG. 7, the gear 613 attached to the output rotation shaft 612 of the second motor 61 is meshed with a large-diameter gear 62. A small-diameter gear 622 is attached to a rotational shaft 621 to which the large-diameter gear 62 is attached. That is, the large-diameter gear 62 and the small-diameter gear 622 rotate about the rotational shaft 621. Here, the large-diameter gear 62 and the small-diameter gear 622 may be integrally formed by molding.

As illustrated in FIG. 8, the small-diameter gear 613 is meshed with external teeth 633 formed in an arcuate portion 632 of the attachment gear part 63 described later. Due to such constitution, the driving force depending on the output of the second motor 61 is transmitted to the attachment gear part 63.

As illustrated in FIG. 7, the attachment gear part 63 has a cylindrical portion 631 and the arcuate portion 632. For example, the attachment gear part 63 is formed of a resin material or the like. The arcuate portion 632 is larger in diameter than the first cylindrical portion 421, and continuously extends to a part of the outer peripheral face of the cylindrical portion 631. Furthermore, the external teeth 633 are formed in a part of the outer peripheral face of the arcuate portion 632. In the example illustrated in FIG. 6 and FIG. 7, the external teeth 633 are formed in the range of 90° set as the central angle with respect to the outer peripheral face of the arcuate portion 632.

Furthermore, as illustrated in FIG. 9, a large-diameter part 222 having a through hole in the center portion thereof is formed on the attachment face 221. The large-diameter part 222 is formed in an annular shape as viewed in a plan view. A small-diameter part 223 that is smaller in diameter than the large-diameter part 222 is formed in a stacked manner on the large-diameter part 222 formed on the attachment face 221. The small-diameter part 223 is formed in an annular shape as viewed in a plan view, and has a through hole that communicates with the through hole of the large-diameter part 222 in the center portion thereof. The attachment face 221 has a through hole passing through the center portion of the large-diameter part 222 and the small-diameter part 223. The attachment gear part 63 inserts the small-diameter part 223 into the inside of the cylindrical portion 631 so as to be arranged in a stacked manner with the large-diameter part 222 formed on the attachment face 221. Here, the rotation of the attachment gear part 63 also causes the light source unit 30 to rotate in the vertical direction, as will be specifically described later.

Here, the explanation is made with respect to the restriction of the rotation range of the attachment gear part 63 in conjunction with FIG. 7. End portions 636 and 637 have respective arcuate portions that are smaller in diameter than the arcuate portion 632, and extend from the respective end portions 636 and 637 in the circumferential direction of the arcuate portion 632 of the attachment gear part 63. Distal end portions 634 and 635 are formed on the respective distal ends of the end portions 636 and 637 in the respective extending directions thereof. In the example illustrated in FIG. 7, the distal end portions 634 and 635 are formed so that the angle formed by straight lines that connect the center of the attachment gear part 63 and the respective distal end portions 634 and 635 is set to 90°.

Furthermore, as illustrated in FIG. 7, a second switch 64 is arranged on the attachment face 221 at a position along the outer periphery of the large-diameter part 222. For example, the second switch 64 has a lever 641 projecting to the small-diameter part 223 side along the planar surface of the large-diameter part 222. For example, the lever 641 of the second switch 64 projects in such a manner that the distal end portion of the lever 641 is located between the distal end portion 634 and the distal end portion 635 of the arcuate portion 632 in the circumferential directions. Here, the distal end portion 634 (635) of the arcuate portion 632 rotates the lever 641 of the second switch 64 thus detecting the limit of the rotational angle set to stop the operation of the second motor 61. This mechanism is used for motor control as described above. In the present embodiment, the attachment gear part 63 uses the distal end portions 634 and 635 of the arcuate portion 632 in cooperation with the second switch 64 to restrict the rotational angle of the light source unit 30 within 90° in the vertical direction.

Furthermore, as illustrated in FIG. 9, restriction pieces 224 and 225 are formed on the attachment face 221 along the outer periphery of the large-diameter part 222, the restriction pieces 224 and 225 facing each other in an opposed manner in the circumferential direction of the large-diameter part 222. For example, the restriction pieces 224 and 225 of the large-diameter part 222 are arranged so that the restriction pieces 224 and 225 overlap with the end portions 636 and 637 of the arcuate portion 632 in the circumferential direction of the arcuate portion 632. Here, the restriction pieces 224 and 225 of the large-diameter part 222 are brought into contact with the respective end portions 636 and 637 of the arcuate portion 632 thus restricting physically the rotation of the attachment gear part 63 about the second rotational axis.

In the example illustrated in FIG. 7, when the attachment gear part 63 rotates clockwise about the second rotational axis, the end portion 636 of the arcuate portion 632 is brought into contact with the restriction piece 224 of the large-diameter part 222 thus restricting the clockwise rotation of the attachment gear part 63 about the second rotational axis. Furthermore, in the example illustrated in FIG. 7, when the attachment gear part 63 rotates counterclockwise about the second rotational axis, the end portion 637 of the arcuate portion 632 is brought into contact with the restriction piece 225 of the large-diameter part 222 thus restricting the counterclockwise rotation of the attachment gear part 63 about the second rotational axis. In this manner, the restriction pieces 224 and 225 of the large-diameter part 222, and the end portions 636 and 637 of the arcuate portion 632 are capable of restricting the rotation of the attachment gear part 63 about the second rotational axis in an intended range. Here, as illustrated in FIG. 9, the large-diameter part 222 is provided with an insertion hole 226, as will be specifically described later.

Furthermore, as illustrated in FIG. 9, a pivotally supporting part 68 is inserted into the through hole of the attachment face 221. To be more specific, a cylindrical portion 681 of the pivotally supporting part 68 is inserted into the through hole of the attachment face 221. Here, a sliding bearing 680 is arranged between the through hole of the attachment face 221 and the cylindrical portion 681 of the pivotally supporting part 68. The sliding bearing 680 is capable of smoothly rotating the cylindrical portion 681 of the pivotally supporting part 68 with respect to the through hole of the attachment face 221.

Figure 10:
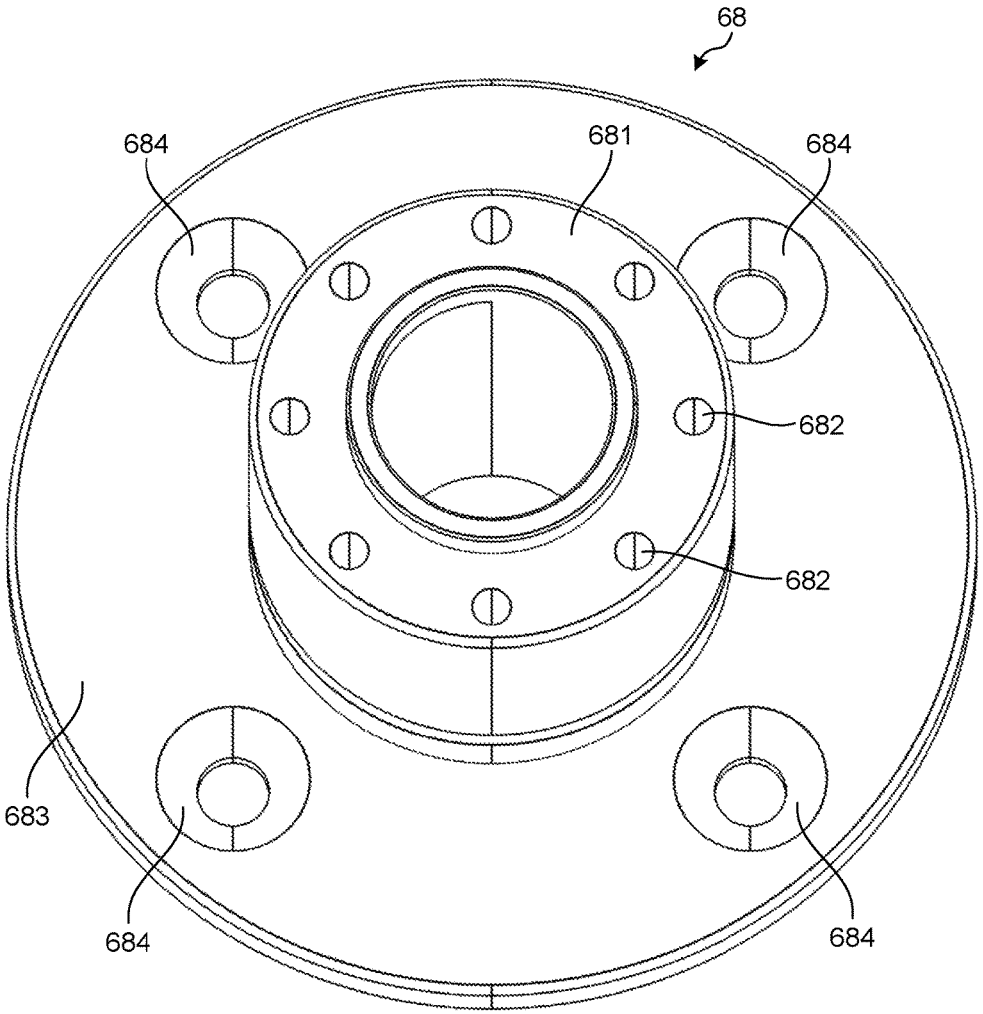
FIG. 10 is a perspective view illustrating a pivotally supporting part of the illumination apparatus according to the embodiment.
Figure 11:
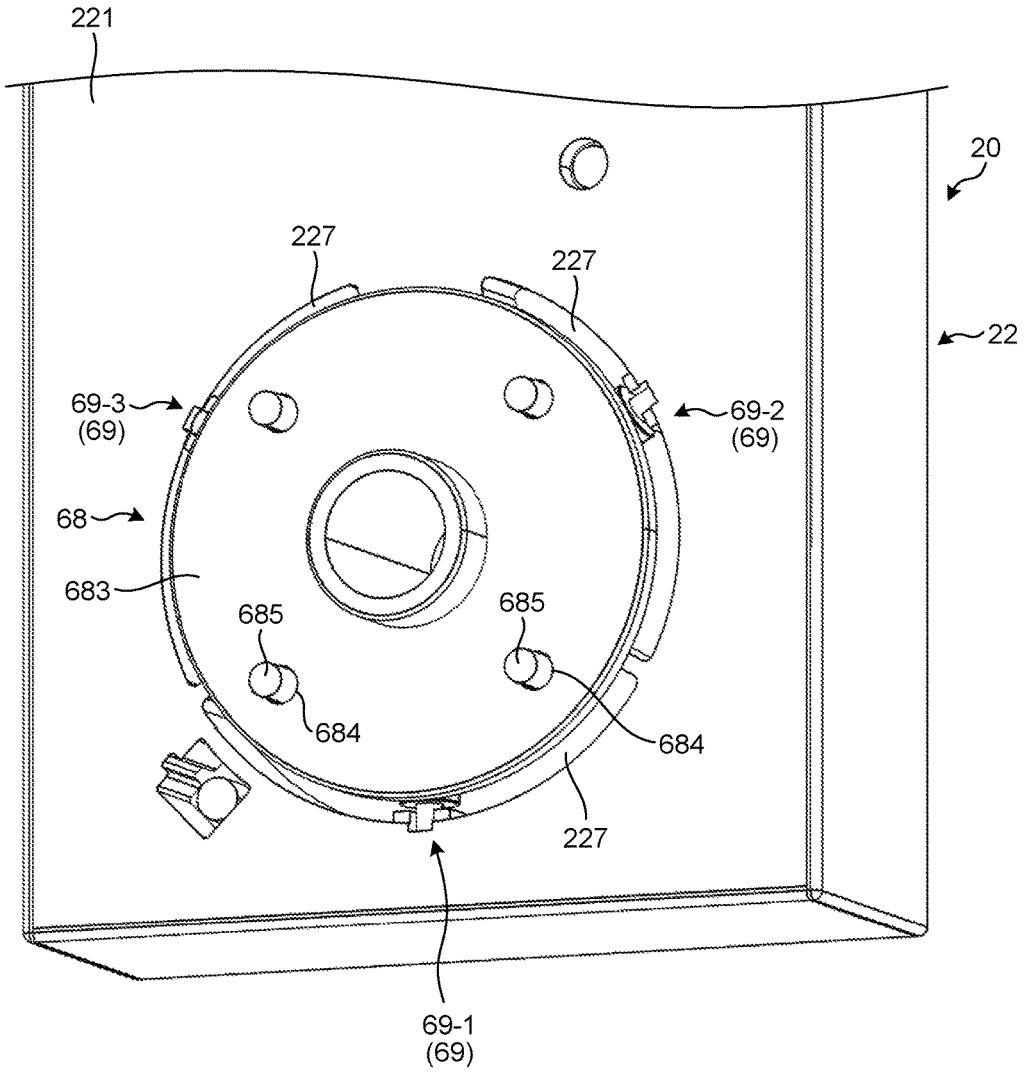
FIG. 11 is a perspective view illustrating the relation between the pivotally supporting part and the other end part of the arm in the illumination apparatus according to embodiment.
Figure 12:
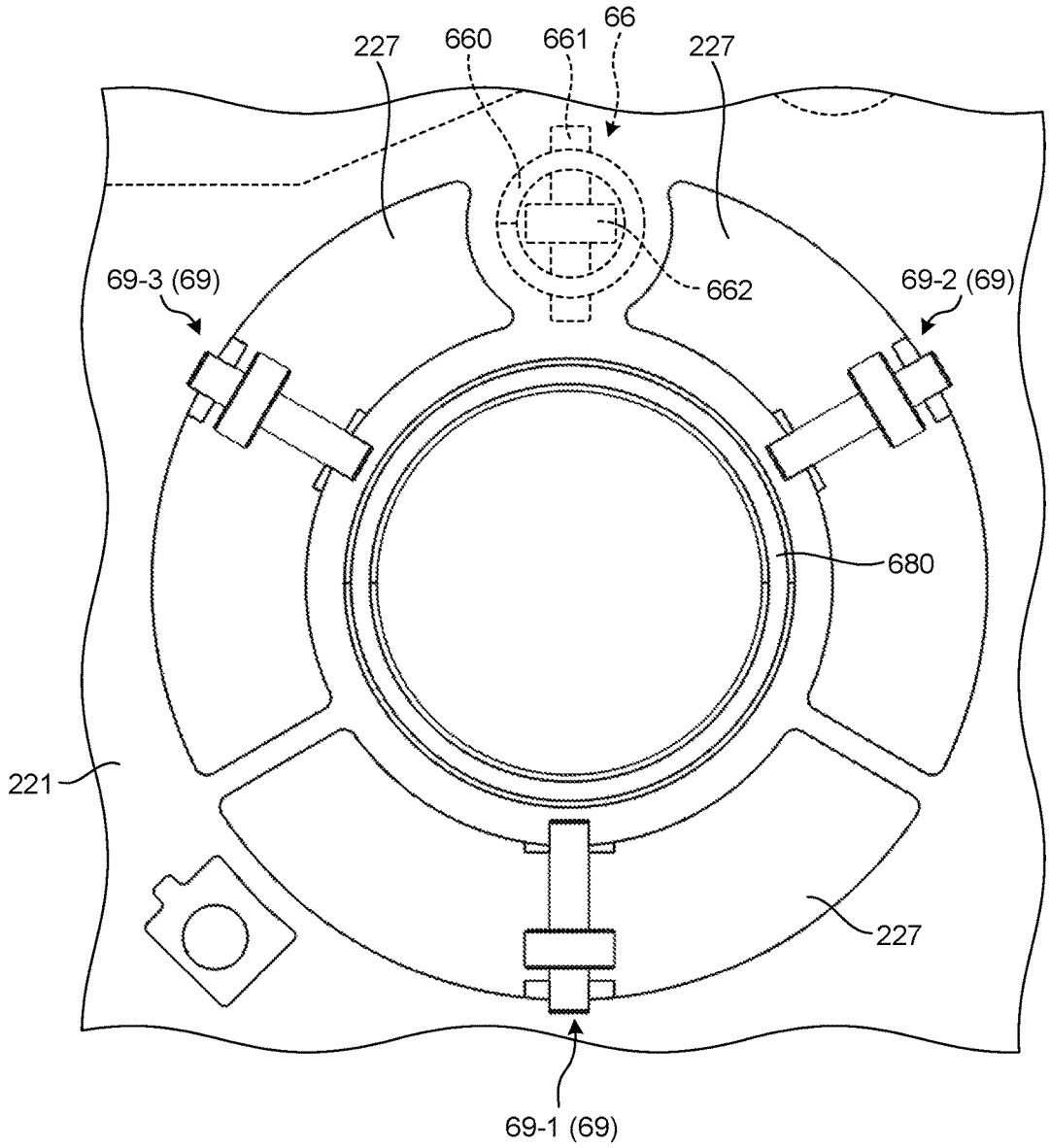
FIG. 12 is a partially perspective view illustrating the arrangement of bearings in the illumination apparatus according to the embodiment.

Furthermore, as illustrated in FIG. 10, in the cylindrical portion 681 of the pivotally supporting part 68, a flange portion 683 that is larger in diameter than the cylindrical portion 681 continuously extends from the cylindrical portion 681. FIG. 10 is a perspective view illustrating the pivotally supporting part of the illumination apparatus according to the embodiment. The flange portion 683 of the pivotally supporting part 68 is larger in diameter than the through hole of the attachment face 221. Accordingly, as illustrated in FIG. 11, the flange portion 683 of the pivotally supporting part 68 is brought into contact with the attachment face 221 from the outside of the attachment face 221. FIG. 11 is a perspective view illustrating the relation between the pivotally supporting part and the other end part of the arm in the illumination apparatus according to the embodiment. Furthermore, as illustrated in FIG. 12, the attachment face 221 has recessed portions 227 each of which is indented from the outside to the inside thereof, as will be specifically described later. FIG. 12 is a partially perspective view illustrating the arrangement of bearings in the illumination apparatus according to the embodiment.

Figure 13:
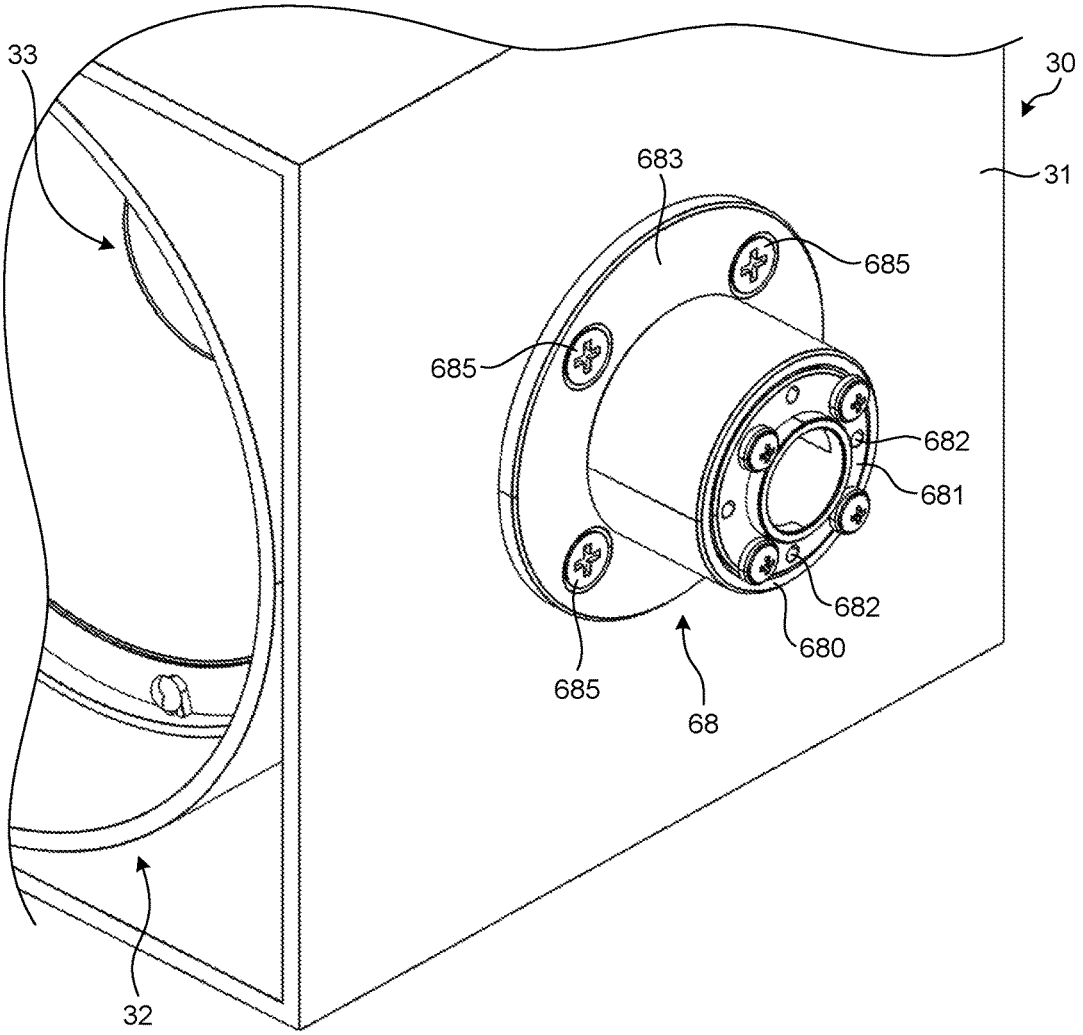
FIG. 13 is a perspective view illustrating the relation between the pivotally supporting part and a light source unit in the illumination apparatus according to the embodiment.

Furthermore, as illustrated in FIG. 13, the light source unit 30 is attached to the pivotally supporting part 68 by the flange portion 683. FIG. 13 is a perspective view illustrating the relation between the pivotally supporting part and the light source unit in the illumination apparatus according to the embodiment. To be more specific, a housing part 31 of the light source unit 30 is attached to the pivotally supporting part 68 with the use of screws 685 that are threadedly engaged into respective attachment holes 684 (see FIG. 11) formed in the flange portion 683. For example, the light source unit 30 is attached to the pivotally supporting part 68 with the use of the screws 685 that are threadedly engaged into the respective attachment holes 684 and respective attachment holes (not illustrated in the drawings) formed in the housing part 31.

The cylindrical portion 681 of the pivotally supporting part 68 is provided with a plurality of attachment holes 682, and attached to the attachment gear part 63 by a predetermined mechanism, such as screwing. In the example illustrated in FIG. 9, the cylindrical portion 681 is provided with eight attachment holes 682, and attached to the attachment gear part 63 by threadedly engaging screws into four attachment holes 682 out of eight attachment holes 682. Due to such constitution, the attachment gear part 63 holds the light source unit 30 with the pivotally supporting part 68 on the arm 20. Here, the pivotally supporting part 68 and the attachment gear part 63 may be integrally formed. For example, the attachment gear parts 63 may be formed as a part of the pivotally supporting parts 68.

As mentioned above, a load attributed to the weight of the light source unit 30 is applied to the attachment gear part 63 (see FIG. 8) in the direction toward the light source unit 30 side (left side in FIG. 8). Accordingly, in the illumination apparatus 1, the insertion hole 226 (see FIG. 12) is formed in the large-diameter part 222 at a position such that the insertion hole 226 overlaps with the attachment gear part 63, and a bias part 66 is arranged in the insertion hole 226. The bias part 66 has a spring member 660, a shaft 661, and a bearing 662. For example, a coil spring is used for the spring member 660. That is, the spring member 660 is arranged between the light source unit 30 and the arm 20.

Furthermore, as illustrated in FIG. 9, the spring member 660 is arranged above the second rotational axis in the gravity direction (Y-axis negative direction). To be more specific, the spring member 660 is arranged above the cylindrical portion 681 of the pivotally supporting part 68 in the gravity direction (Y-axis negative direction). In this manner, the spring member 660 arranged in the insertion hole 226 biases the attachment gear part 63 in the direction away from the light source unit 30 thus biasing the light source unit 30 in the direction toward the arm 20 along the second rotational axis.

For example, the weight of the light source unit 30 causes the pivotally supporting part 68 and the attachment gear part 63 that are attached to the light source unit 30 to move to the light source unit 30 side and hence, there may be a case that wobbling is caused in the light source unit 30. This may result in the breakage of the connection portion between the arm 20 and the light source unit 30. Accordingly, in the illumination apparatus 1, the spring member 660 is arranged between the light source unit 30 and the arm 20; that is, between the attachment gear part 63 to which the pivotally supporting part 68 is attached, and the attachment face 221. Due to such constitution, the spring member 660 biases the attachment gear part 63 to which the pivotally supporting part 68 is attached thus suppressing the inclination of the light source unit 30 caused by the weight of the light source unit 30, and ensuring the posture of the small-diameter gear 622 normally meshed with the external teeth 633.

In this manner, the illumination apparatus 1 is capable of suppressing incomplete meshing of the small-diameter gear 622 with the external teeth 633 thus suppressing the breakage of the small-diameter gear 622, the external teeth 633, or the like, and the failure of a tilting mechanism. Accordingly, the illumination apparatus 1 is capable of suppressing troubles due to the weight of the light source unit 30. The illumination apparatus 1 is constituted so that the light source unit 30 is located on the first rotational axis. For example, the illumination apparatus 1 is constituted so that the light source unit 30 is located on the first rotational axis even when the light source unit 30 rotates in either direction of rotation (clockwise or counterclockwise) in the horizontal direction depending on the output of the first motor 45. Due to such constitution, the illumination apparatus 1 is capable of suppressing the inclination of the second rotational axis due to the weight of the light source unit 30 that is applied to the support unit 10 and the arm 20. In this manner, the illumination apparatus 1 is capable of suppressing the inclination of the posture thereof due to the weight of the light source unit 30 that is applied to the arm 20 or the like.

Furthermore, the bearing 662 inserted into the shaft 661 is arranged between the attachment gear part 63 and the spring member 660. The spring member 660 biases the shaft 661 to the attachment gear part 63 side. Due to such constitution, the bearing 662 is brought into contact with the attachment gear part 63. Accordingly, when the light source unit 30 is rotated, the bearing 662 slides with respect to the attachment gear part 63 and hence, the light source unit 30 is capable of being rotated smoothly.

Furthermore, the reinforcing plate 65 is arranged between the attachment gear part 63 and the bearing 662. The reinforcing plate 65 is attached to a part of the surface facing the large-diameter part 222 in the attachment gear part 63 with the use of attachment members 651. To be more specific, the reinforcing plate 65 is arranged by the attachment members 651 at a position such that the reinforcing plate 65 overlaps with the insertion hole 226 in the attachment gear part 63 when the light source unit 30 is rotated. For example, the reinforcing plate 65 is attached to the attachment gear part 63 with the use of the attachment members 651 threadedly engaged with respective insertion holes 638 of the attachment gear part 63. For example, the reinforcing plate 65 is made of a metallic material or the like. In this manner, the reinforcing plate 65 is arranged on the part of the attachment gear part 63 that is brought into contact with the bearing 662 thus reinforcing the attachment gear part 63 as a pivotally supporting part. The illumination apparatus 1 may be provided with no reinforcing plate 65.

Furthermore, in order to bias the light source unit 30 by the spring member 660 arranged in the insertion hole 226 in the direction toward the arm 20 along the second rotational axis, as illustrated in FIG. 11, the flange portion 683 of the pivotally supporting part 68 is brought into contact with the attachment face 221 from the outside of the attachment face 221. Accordingly, the flange portion 683 of the pivotally supporting part 68 slides with respect to the attachment face 221 when the light source unit 30 is rotated. As illustrated in FIG. 12, a plurality of recessed portions 227 each of which is indented from the outside to the inside thereof are formed in the attachment face 221. To be more specific, three recessed portions 227 are formed in the attachment face 221. Furthermore, sliding parts 69-1, 69-2, and 69-3 are arranged on the respective recessed portions 227. Here, when explaining without differentiating the sliding parts 69-1, 69-2, and 69-3, they are collectively referred to as "sliding part 69".

One recessed portion 227 (lower side recessed portion 227 in FIG. 12) out of the recessed portions 227 is located at a position opposite to the bias part 66 in the gravity direction (Y-axis negative direction) with respect to the second rotational axis as a center, and located between the light source unit 30 and the arm 20. Accordingly, the sliding part 69-1 is arranged at a position opposite to the bias part 66 in the gravity direction with respect to the second rotational axis as a center, and arranged at a position between the light source unit 30 and the arm 20. In this manner, the bias part 66 and the sliding part 69-1 are arranged with the second rotational axis interposed therebetween thus rotating smoothly the pivotally supporting part 68.

Furthermore, the sliding parts 69-1, 69-2, and 69-3 are arranged at equal intervals with respect to the second rotational axis as a center. In the example illustrated in FIG. 12, the sliding parts 69-1, 69-2, and 69-3 are arranged at 120° intervals. In this manner, the sliding parts 69-1, 69-2, and 69-3 are arranged at equal intervals thus rotating smoothly the pivotally supporting part 68.

Hereinafter, the constitution of the light source unit 30 is explained. As illustrated in FIG. 1 and FIG. 2, the light source unit 30 has the housing part 31, a holding part 32, the light emitting part 33, and a heat radiation part 34. Furthermore, the light emitting part 33 has, for example, a light emitting diode (LED) arranged on a board as a light source that constitutes an object to be changed in a direction thereof. That is, the light source unit 30 is a lamp body capable of changing an irradiation direction thereof.

The housing part 31 is formed in a hollow rectangular shape. As illustrated in FIG. 13, the pivotally supporting part 68 is attached to one surface (right side surface in FIG. 2) of the housing part 31. In this manner, the housing part 31 is attached to the pivotally supporting part 68, and the light source unit 30 is rotated together with the pivotally supporting part 68 about the second rotational axis by the second motor 61. For example, the light source unit 30 is rotated in the perpendicular direction (vertical direction) about the second rotational axis depending on the driving operation of the second motor 61.

Figure 14:
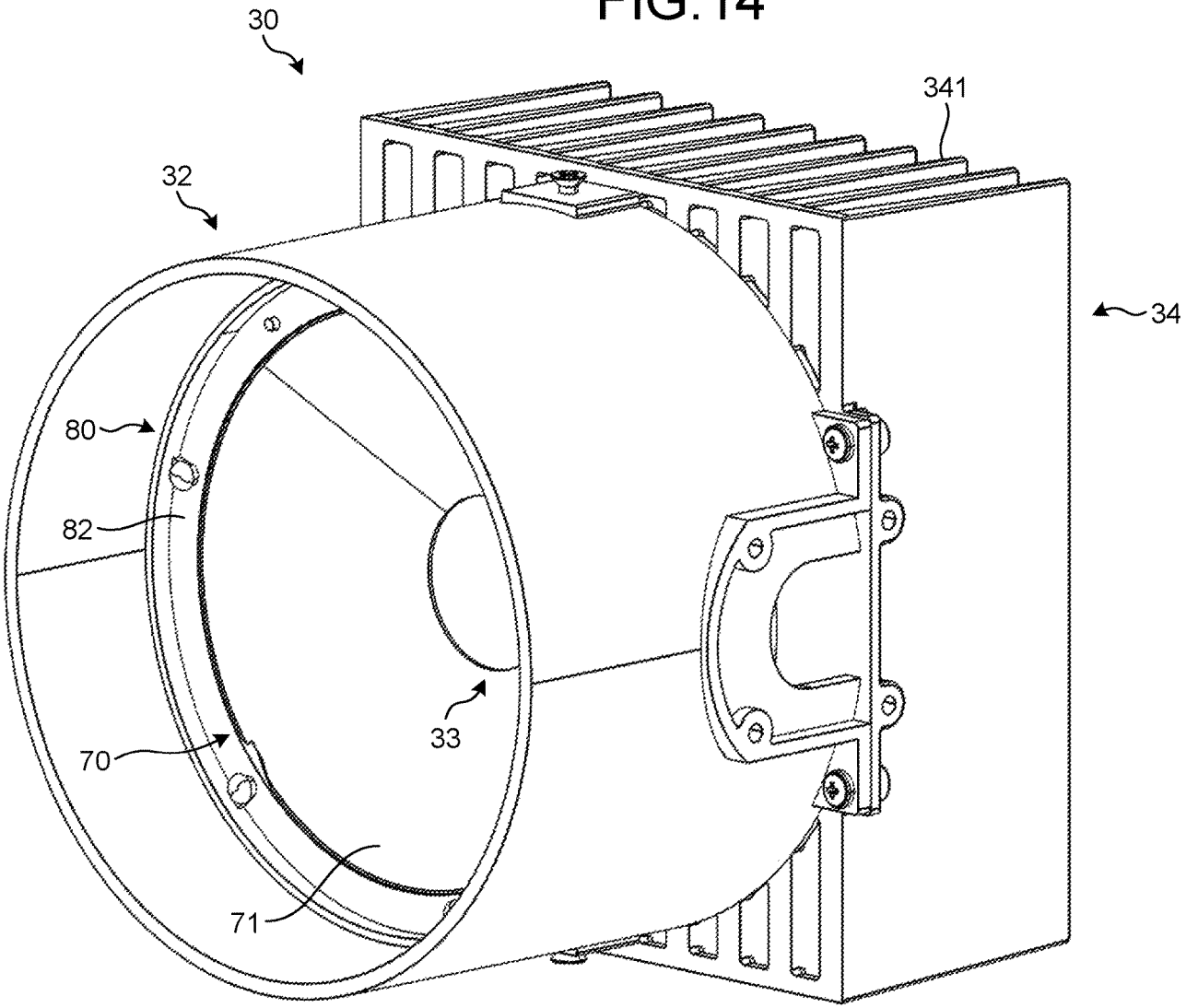
FIG. 14 is a perspective view illustrating the light source unit of the illumination apparatus according to the embodiment.

Next, the explanation is made with respect to the constitution on the inside of the housing part 31 of the light source unit 30 in conjunction with FIG. 14. FIG. 14 is a perspective view illustrating the light source unit of the illumination apparatus according to the embodiment. To be more specific, FIG. 14 is a perspective view illustrating the light source unit 30 except for the housing part 31, in order to illustrate the constitution on the inside of the housing part 31. As illustrated in FIG. 14, the heat radiation part 34 has a plurality of heat radiation fins 341, and is attached to one surface of the holding part 32, the one surface being opposite to the other surface of the holding part 32 that radiates light emitted from the light emitting part 33. In the example illustrated in FIG. 14, the heat radiation part 34 is attached to the holding part 32 by an attachment mechanism, such as screwing. Here, The above-mentioned embodiment merely constitutes one example, and any attachment mechanism may be adopted as the attachment mechanism used for attaching the heat radiation part 34 to the holding part 32.

Figure 15:
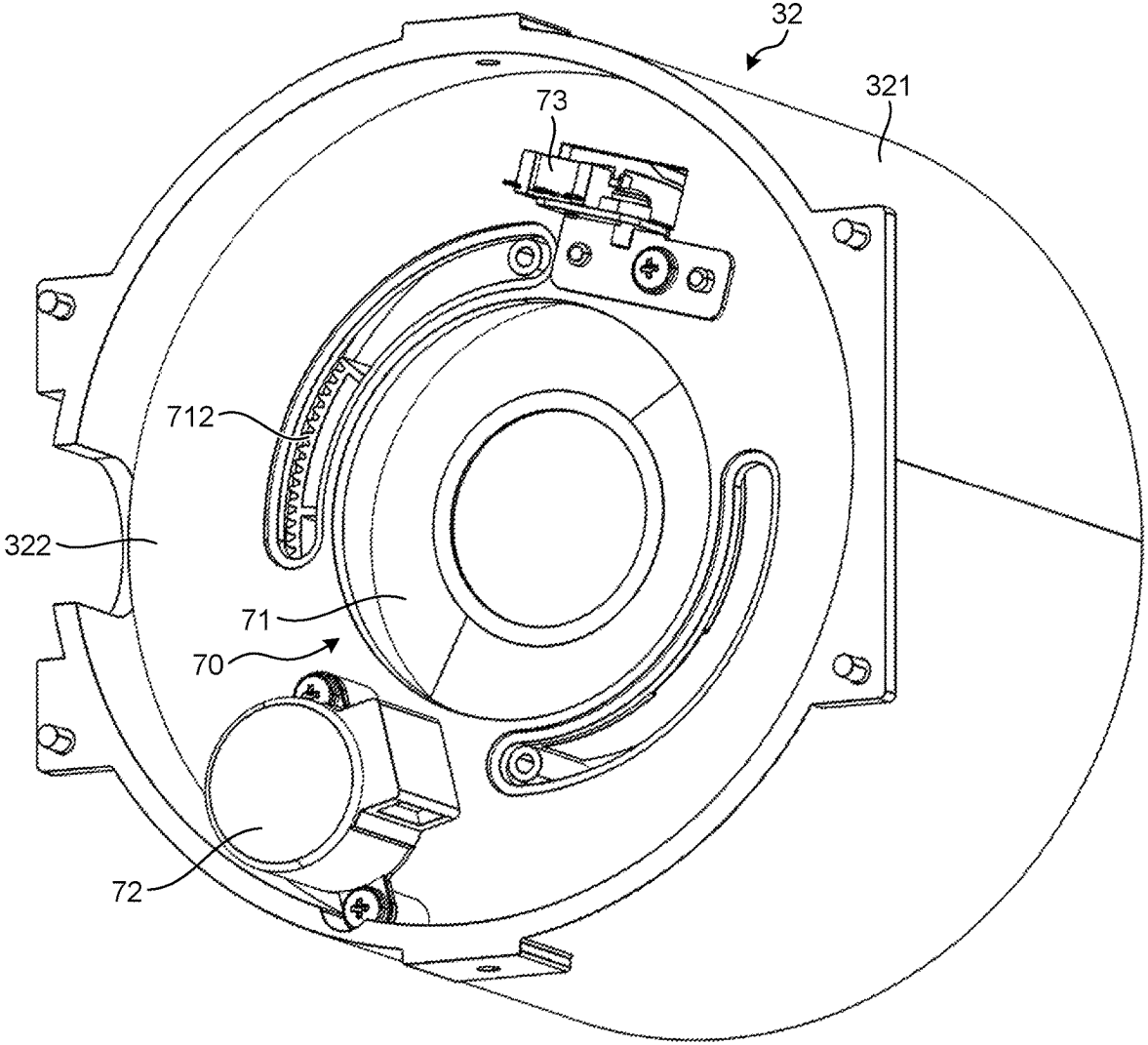
FIG. 15 is a perspective view illustrating a zooming mechanism of the illumination apparatus according to the embodiment.
Figure 16:
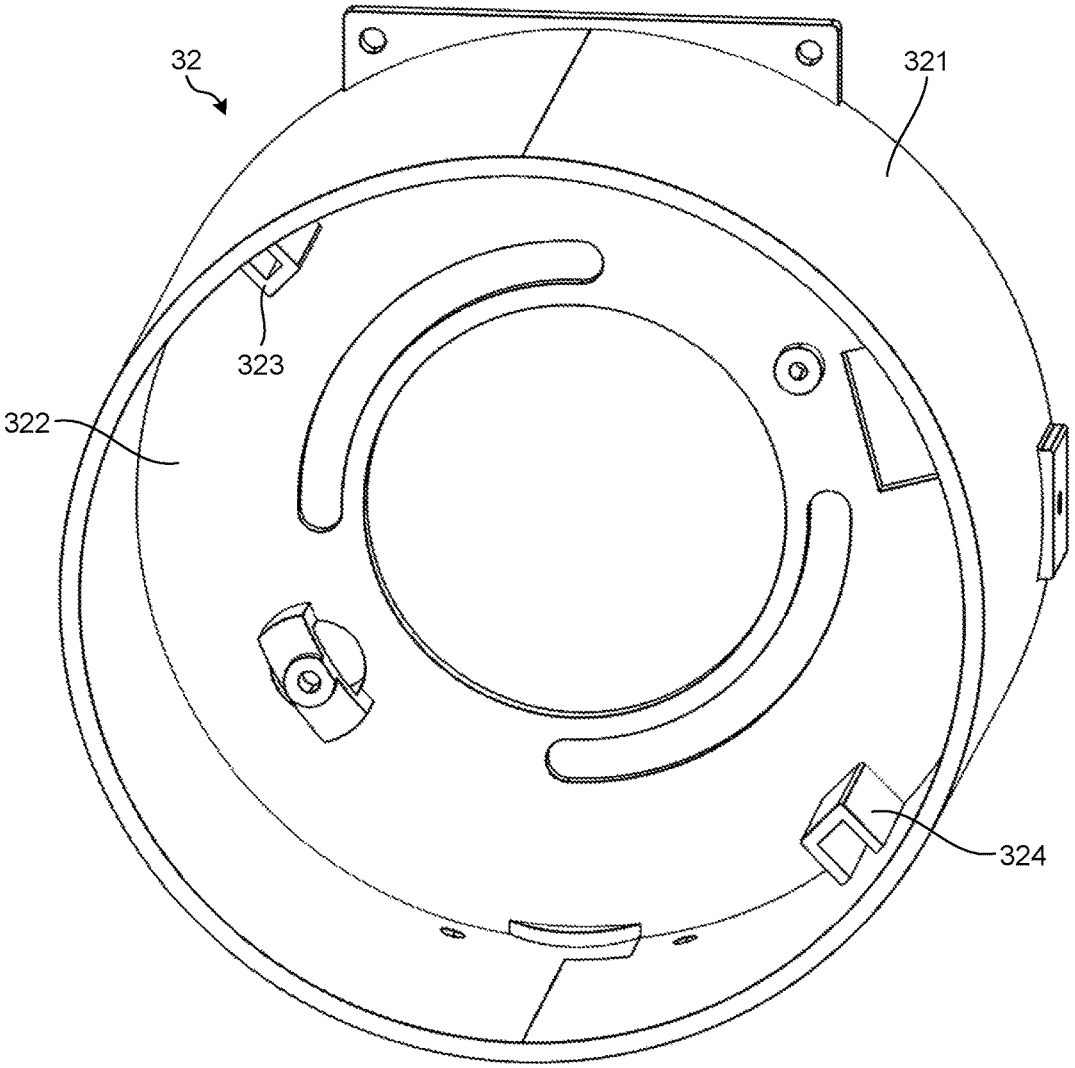
FIG. 16 is a perspective view illustrating a holding part of the illumination apparatus according to the embodiment.
Figure 17:
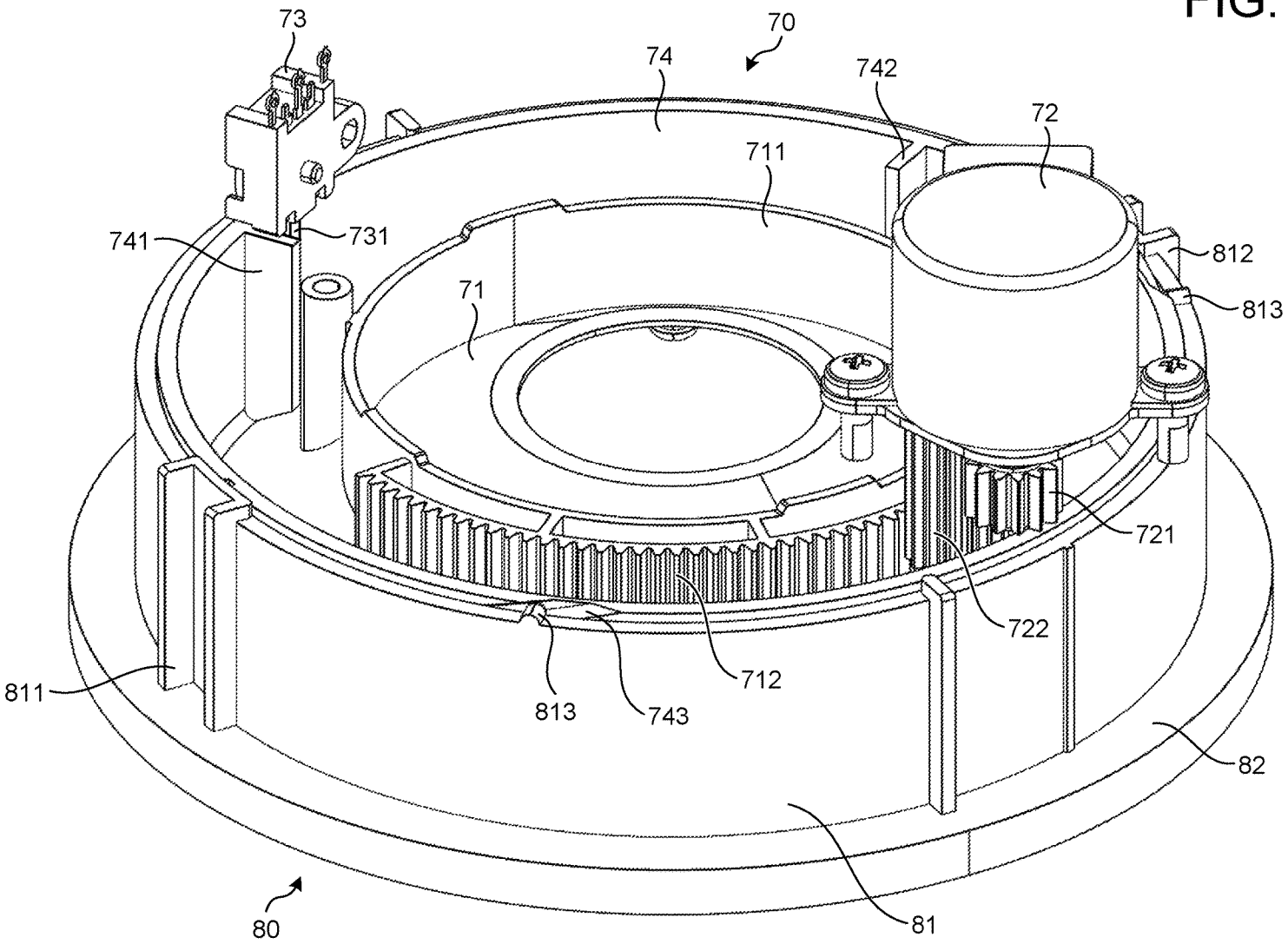
FIG. 17 is a perspective view illustrating the essential part of the zooming mechanism in the illumination apparatus according to the embodiment.
Figure 18:
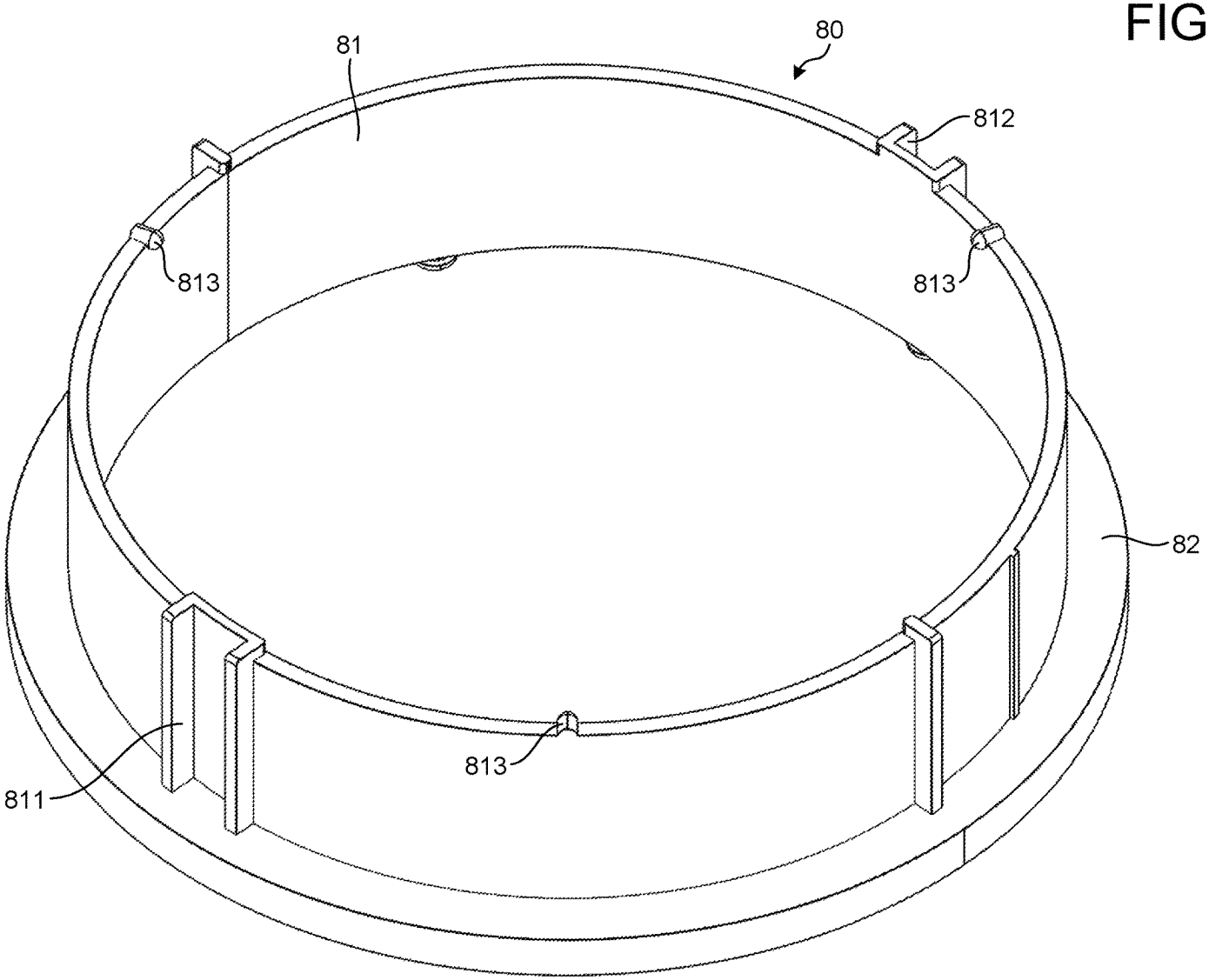
FIG. 18 is a perspective view illustrating an alignment part of the illumination apparatus according to the embodiment.
Figure 19:
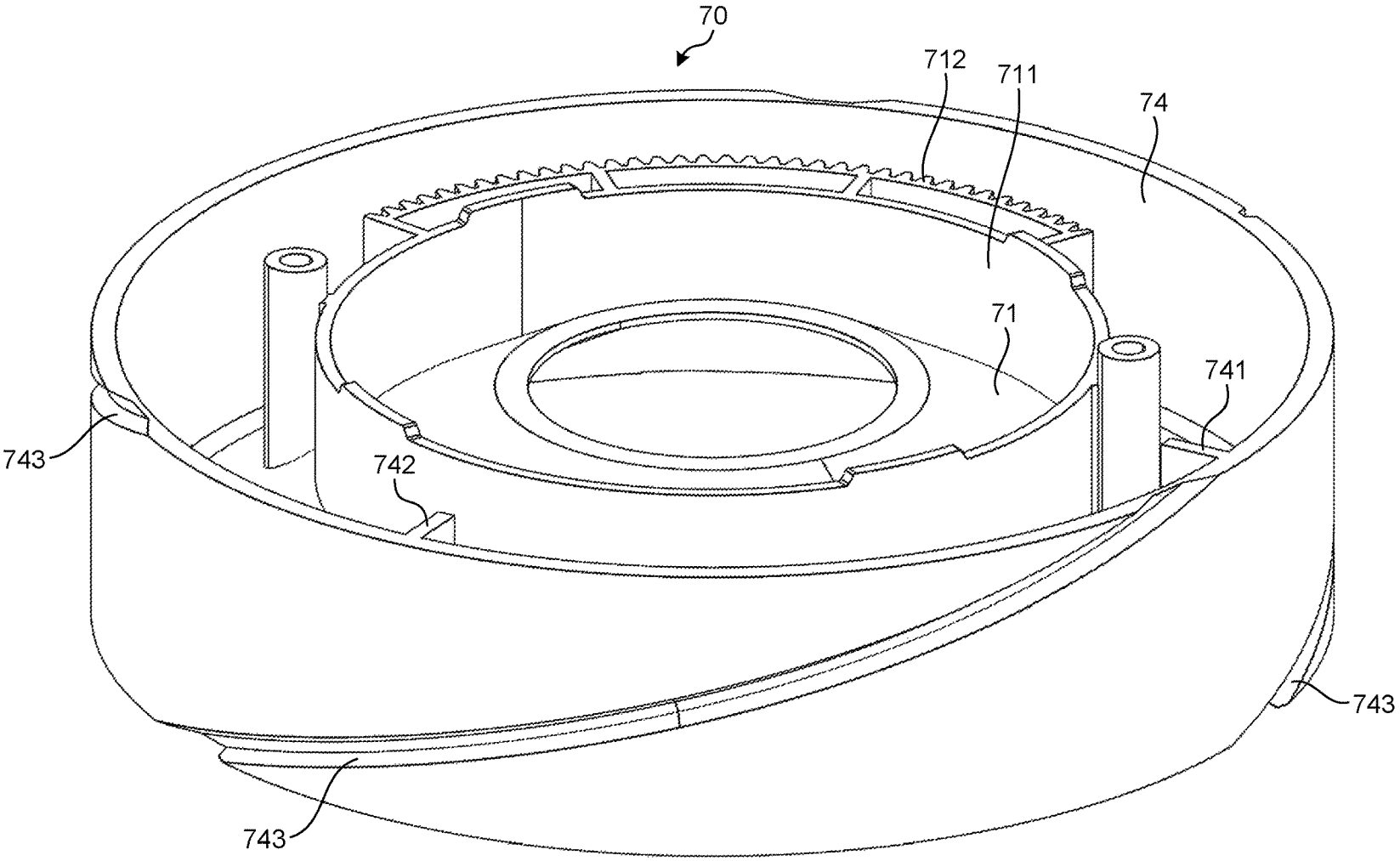
FIG. 19 is a perspective view illustrating a rotational part of the illumination apparatus according to the embodiment.
Figure 20:
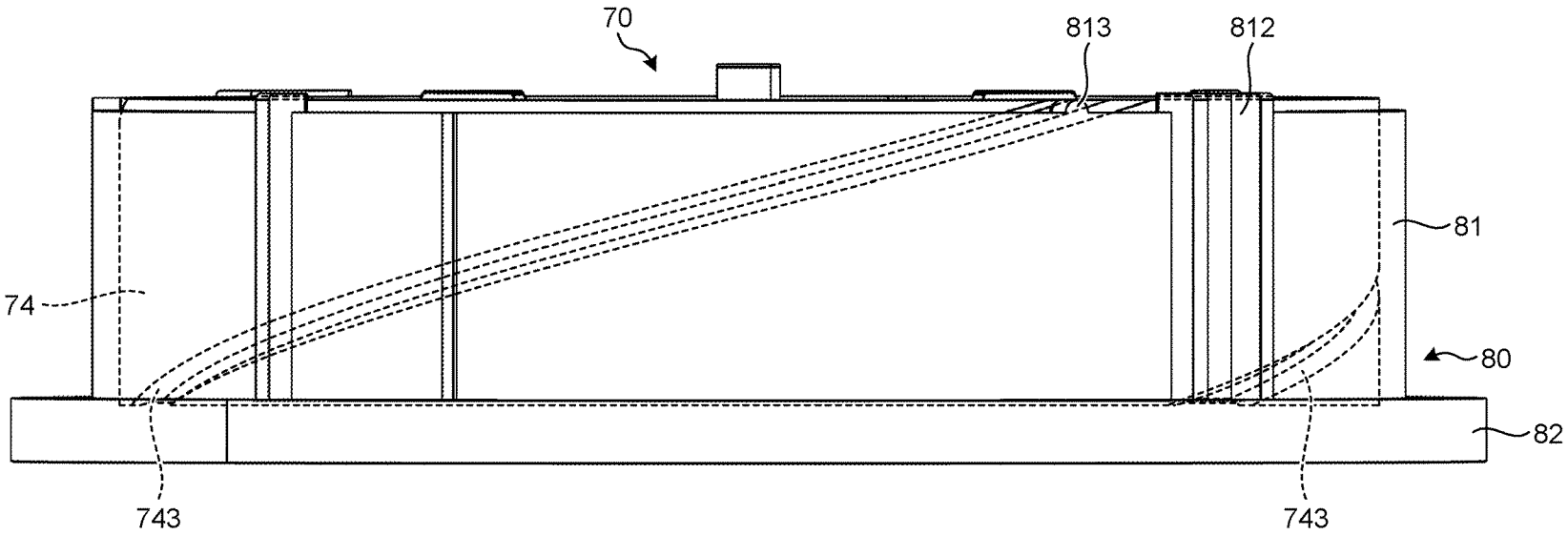
FIG. 20 is a partially perspective view illustrating the zooming mechanism of the illumination apparatus according to the embodiment.

Hereinafter, the constitution of a zooming mechanism is explained in conjunction with FIG. 15 to FIG. 20. FIG. 15 is a perspective view illustrating the zooming mechanism of the illumination apparatus according to the embodiment. FIG. 16 is a perspective view illustrating the holding part of the illumination apparatus according to the embodiment. FIG. 17 is a perspective view illustrating the essential part of the zooming mechanism in the illumination apparatus according to the embodiment. FIG. 18 is a perspective view illustrating an alignment part of the illumination apparatus according to the embodiment. FIG. 19 is a perspective view illustrating a rotational part of the illumination apparatus according to the embodiment. FIG. 20 is a partially perspective view illustrating the zooming mechanism of the illumination apparatus according to the embodiment.

As illustrated in FIG. 15, the holding part 32 has a cylindrical part 321 and a bottom wall part 322. As illustrated in FIG. 14, a reflection part 70 and an alignment part 80 are arranged on the inside of the cylindrical part 321. A third motor 72 that rotates the reflection part 70 is arranged on the bottom wall part 322 of the holding part 32. Furthermore, as illustrated in FIG. 16, a pair of restriction pieces 323 and 324 for moving the alignment part 80 back and forth along the axis of the cylindrical part 321 are provided to the inner peripheral face of the cylindrical part 321 in a projecting manner, as will be specifically described later.

As illustrated in FIG. 17, the reflection part 70 is arranged on the inside of the alignment part 80 in a rotatable manner with respect to the alignment part 80. The reflection part 70 has a reflection surface 71, the third motor 72, and a third switch 73. For example, the light emitting part 33 is arranged in the opening part of the reflection surface 71, and the reflection surface 71 reflects light radiated from the light emitting part 33.

An outer wall 74 is provided to the outer peripheral edge of the reflection surface 71 in a projecting manner toward the back side of the reflection surface 71. In the example illustrated in FIG. 17, the outer wall 74 formed in a cylindrical shape is provided to the outer peripheral edge of the reflection surface 71 in a projecting manner toward the upper side of the reflection surface 71. An inner wall 711 is provided to the reflection surface 71 in a projecting manner toward the back side of the reflection surface 71. In the example illustrated in FIG. 17, the inner wall 711 formed in a cylindrical shape is provided to the reflection surface 71 in a projecting manner from the vicinity of the intermediate portion between the opening part and the outer peripheral edge in the reflection surface 71 toward the upper side of the reflection surface 71. Furthermore, a gear part 712 is formed on a part of the outer peripheral face of the inner wall 711. For example, the gear part 712 is formed in an extending manner over the range of 90° set as the central angle of the circular shape of the inner wall 711.

The third motor 72 is attached to the bottom wall part 322 of the holding part 32. For example, a geared motor is used for the third motor 72. Here, not only the geared motor but also various kinds of motors, such as a DC motor, a DC brush-less motor, an AC motor, or a stepping motor, may be used for the third motor 72. A gear 721 is attached to the output rotation shaft (not illustrated in the drawings) of the third motor 72. The gear 721 attached to the output rotation shaft of the third motor 72 is meshed with a gear 722. Furthermore, the gear 722 is meshed with the gear part 712 of the inner wall 711. Due to such constitution, the reflection part 70 is rotated depending on the output of the third motor 72.

A pair of projecting portions 741 and 742 projecting to the inside of the outer wall 74 are formed on the inner peripheral face of the outer wall 74. Furthermore, the third switch 73 is attached to the bottom wall part 322 of the holding part 32, and arranged at the position such that a lever 731 projects along the inner peripheral face of the outer wall 74. To be more specific, the third switch 73 is arranged at the position such that the lever 731 overlaps with the projecting portions 741 and 742 in the circumferential direction of the outer wall 74. Due to such constitution, either one of the projecting portions 741 and 742 of the outer wall 74 rotates the lever 731 of the third switch 73 thus detecting the limit of the rotational angle set to stop the operation of the third motor 72. This mechanism is used for motor control as described above. In the present embodiment, the third switch 73 and the projecting portions 741 and 742 of the outer wall 74 restrict the rotational angle of the reflection part 70 within the range of approximately 90°.

Furthermore, as illustrated in FIG. 18, the alignment part 80 has a cylinder part 81 formed in a cylindrical shape, and a flange part 82 extending continuously to the cylinder part 81. For example, an optical member (not illustrated in the drawings), such as a lens, is arranged on the flange part 82. The cylinder part 81 of the alignment part 80 is provided with a plurality of guide grooves 811 and 812 each of which is formed in a projecting manner from the outer peripheral face of the cylinder part 81. In the example illustrated in FIG. 18, two restriction grooves 811 and 812 are formed at 180° intervals along the outer periphery of the cylinder part 81. That is, the pair of guide grooves 811 and 812 are formed in a projecting manner at respective positions opposite to each other with respect to the axis of the cylinder part 81 of the alignment part 80 as a center.

Here, the guide groove 811 (812) of the alignment part 80 is formed in such a shape that the restriction piece 323 (324) of the cylindrical part 321 of the holding part 32 is inserted into the guide groove 811 (812), and the restriction pieces 323 and 324 of the cylindrical part 321 are inserted into the respective guide grooves 811 and 812 of the alignment part 80. For example, the restriction piece 323 of the cylindrical part 321 is inserted into the guide groove 811 of the alignment part 80. Furthermore, for example, the restriction piece 324 of the cylindrical part 321 is inserted into the guide groove 812 of the alignment part 80. Due to such constitution, the alignment part 80 is capable of moving back and forth along the axial direction of the cylindrical part 321 of the holding part 32 by way of the guide grooves 811 and 812.

Projection portions 813 are formed in the inner peripheral face of the cylinder part 81 of the alignment part 80. For example, three projection portions 813 are formed in the inner peripheral face of the cylinder part 81 of the alignment part 80 at equal intervals along the inner periphery of the cylinder part 81. For example, three projection portions 813 are formed at 120° intervals along the inner periphery of the cylinder part 81. In the example illustrated in FIG. 18, three projection portions 813 are formed on the upper end of the inner peripheral face of the cylinder part 81.

Furthermore, a plurality of grooves 743 formed in a spiral manner are provided to the outer peripheral face of the outer wall 74 in the reflection part 70. For example, three grooves 743 are formed in the outer peripheral face of the outer wall 74 in the reflection part 70 at equal intervals along the outer periphery of the outer wall 74. For example, three grooves 743 are formed at 120° intervals along the outer periphery of outer wall 74.

Here, the restriction pieces 323 and 324 of the holding part 32 are inserted into the respective guide grooves 811 and 812 thus restricting the rotation of the alignment part 80 about the axis of the cylinder part 81. For example, in the case of FIG. 20, the alignment part 80 is movable in the direction (vertical direction) along the axis of the cylinder part 81, and the rotation of the alignment part 80 about the axis extending in the vertical direction is restricted. On the other hand, the reflection part 70 rotates about the axis of the reflection part 70 along the vertical direction depending on the output of the third motor 72.

Accordingly, the reflection part 70 rotates to change the position of the groove 743 in the reflection part 70 thus changing the position of the projection portion 813 in the axial direction while restricting the position of the projection portion 813 of the alignment part 80 in the rotational direction. Here, the alignment part 80 converts the rotation about the axis of the reflection part 70 into the movement in the axial direction. Due to such constitution, the alignment part 80 moves back and forth in the axial direction depending on the rotation of the reflection part 70 about the axis of the reflection part 70. In this manner, the alignment part 80 moves in the axial direction thus changing the distance between the light emitting part 33 and the optical member arranged on the flange part 82 of the alignment part 80 to achieve a zoom function.

Here, in the present embodiment, three grooves 743 are formed in the reflection part 70 at 120° intervals in such a manner that the grooves 743 function only in a moving range of the alignment part 80 that moves back and forth in the axial direction. Furthermore, three projection portions 813 to be slidably engaged with the respective grooves 743 of the reflection part 70 are also formed on the alignment part 80 at 120° intervals. In this manner, three grooves 743 of the reflection part 70 correspond to respective three projection portions 813 of the alignment part 80 thus moving the alignment part 80 back and forth in a well-balanced manner due to a three-point supporting structure. Furthermore, the distal end portion of the projection portion 813 of the alignment part 80 may be formed in an elongated shape provided that the projection portion 813 can be slidably engaged with the groove 743 of the reflection part 70.

As mentioned above, the illumination apparatus 1 is capable of rotating the arm 20 in the horizontal direction thus rotating an irradiation direction (irradiation axis) of the light source unit 30 in the horizontal direction in a state in which the tilting angle of the irradiation axis with respect to the vertical line is maintained. Although the rotating operation of the arm 20 in the horizontal direction depending on the first motor 45 and the rotating operation of the light source unit 30 in the vertical direction depending on the second motor 61 are individually explained, the controller is capable of controlling simultaneously the first motor 45, the second motor 61, and the third motor 72 depending on the operation of a remote controller by an operator. For example, the illumination apparatus 1 is capable of performing simultaneously the rotating operation of the arm 20 in the horizontal direction, and the rotating operation of the light source unit 30 in the vertical direction.

According to the present embodiment, the first motor 45 for rotating the arm 20 in the horizontal direction, and the second motor 61 for rotating the light source unit 30 in the vertical direction are arranged on the inside of the arm 20 to constitute the illumination apparatus 1.

The present invention is not limited to the above-mentioned embodiment. The present invention includes a case of constituting the above-mentioned respective components optionally by combining them with each other. In addition, additional effects or modifications can easily be provided by those skilled in the art. Therefore, the more extensive aspect of the present invention is not limited to the above-mentioned embodiment, and various modifications can be made.

For example, the illumination apparatus 1 can be constituted as follows. The plurality of illumination apparatuses 1 are arranged on a ceiling or the like, and the respective illumination apparatuses 1 are connected with each other through wireless communication thus constituting the controller 50 so that the illumination apparatuses 1 can be simultaneously operated by remote control with one remote controller. Furthermore, the controller 50 is not limited to the remote controller using wireless communication, and an operation unit operated by the operator and the illumination apparatus 1 may be, for example, wiredly connected with each other.

Although the illumination apparatus 1 suspending from a ceiling is exemplified in the embodiment, the present invention is also applicable to an illumination apparatus suspending from a wall surface. Not only a stepping motor but also a DC motor, a DC brush-less motor, an AC motor, or the like is applicable to the first motor 45 and the second motor 61. In this case also, the rotational angle (the amount of angular displacement) of the arm 20 in the horizontal direction, and the rotational angle (the amount of angular displacement) of the light source unit 30 in the vertical direction are made to coincide with each other or to coordinate with each other thus simplifying current control by the controller 50. Furthermore, a light source is not limited to a light emitting element such as an LED, and may be any other light source such as a krypton bulb.

The drive apparatus may be used not only for changing the direction of the light source unit 30 including the light source provided to the illumination apparatus 1 according to the embodiment but also for changing the direction of any operation target. For example, the operation target may be a surveillance camera or the like. In this manner, the operation target is required to change the direction thereof to an intended direction, and any operation target may be used provided that the operation target is applicable to the drive apparatus.

According to one embodiment of the present invention, it is possible to suppress the troubles due to the weight of the operation target in a state in which the operation target is capable of changing the direction thereof in an intended direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A drive apparatus comprising:

a support unit including an electrically-driven first driving source;

an arm extending from one end part to another end part that is opposite to the one end part, the arm supported by the support unit at the one end part of the arm, and, by the first driving source, rotatable about a first rotational axis that is along an extending direction of the other end part, the arm at the other end part including an electrically-driven second driving source, with a through-hole being formed on an attachment face of the other end part;

a pivotally supporting part being fixed to an operation target and being inserted into the through hole at the other end of the arm;

an attachment gear part being attached to the pivotally supporting part and holding the operation target and the pivotally supporting part on the other end part of the arm, wherein the pivotally supporting part and the operation target are, by the second driving source, rotatable about a second rotational axis intersecting with the extending direction; and a spring member configured to bias the operation target in a direction toward the arm along the second rotational axis, the spring member being arranged between the attachment gear part and the attachment face.

2. The drive apparatus according to claim 1, wherein the spring member is arranged inside the arm, biases the pivotally supporting part in a direction away from the operation target, and biases a part of the arm facing the operation target to the operation target side so as to bias the operation target in the direction toward the arm.

3. The drive apparatus according to claim 1, further comprising a bearing arranged between the operation target and the spring member.

4. The drive apparatus according to claim 1, wherein the operation target is arranged below the support unit in a gravity direction, and arranged at a position where the operation target overlaps with the support unit as viewed in a plan view.

5. The drive apparatus according to claim 4, wherein the spring member is arranged above the second rotational axis in the gravity direction.

6. The drive apparatus according to claim 5, wherein a sliding part is arranged at a position opposite to the spring member in the gravity direction with respect to the second rotational axis as a center, and arranged at a position between the operation target and the arm.

7. The drive apparatus according to claim 6, wherein a plurality of sliding parts including the sliding part are arranged between the operation target and the arm at equal intervals with respect to the second rotational axis as a center.

8. The drive apparatus according to claim 7, wherein each of the plurality of sliding parts is a bearing.

9. The drive apparatus according to claim 1, comprising, inside the arm, a control board configured to control the first driving source and the second driving source.

10. The drive apparatus according to claim 9, wherein the one end part of the arm extends in a direction intersecting with the first rotational axis, the other end part of the arm continuously extends from the one end part in a direction along the first rotational axis, and the control board is arranged on the other end part inside the arm.

11. An illumination apparatus that is the drive apparatus according to claim 1, the drive apparatus including a light source unit as the operation target.

* * * * *